United States Patent [19]

Durley, III

[11] 4,232,304

[45] Nov. 4, 1980

[54] VIBRATORY-ROTARY MOTION CONVERTERS AND DISPLAY DEVICES INCORPORATING SUCH CONVERTERS

[76] Inventor: Benton A. Durley, III, Rte. 45, Druce Lake, P.O. Box 304, Grayslake, Ill. 60030

[21] Appl. No.: 47,168

[22] Filed: Jun. 11, 1979

[51] Int. Cl.[3] ..... G08B 5/24

[52] U.S. Cl. ..... 340/366 B; 340/373; 310/20; 310/80

[58] Field of Search ..... 340/366 B; 310/20, 80

[56] References Cited

U.S. PATENT DOCUMENTS 2,640,895 6/1953 Boswau ..... 310/20

*Primary Examiner*—Harold I. Pitts

*Attorney, Agent, or Firm*—Burmeister, York, Palmatier, Hamby & Jones

[57] ABSTRACT

The vibratory-rotary motion converter may comprise a vibratory member having a generally cylindrical external surface, supporting means for supporting the vibratory member for axial vibratory motion along the cylindrical axis of such surface, vibration producing means for causing such axial vibratory motion of such member, a rotary member slidably and rotatably mounted around such cylindrical surface for rotary motion relative thereto about the cylindrical axis thereof, a shoulder member on the vibratory member and having a shoulder facing toward said rotary member, and at least one flexible resilient arm on the rotary member and having an end portion extending toward said shoulder for engagement therewith, the arm being oriented for flexing motion in a direction such that the end portion of the arm has axial and circumferential components of motion relative to the cylindrical axis, the rotary member being biased toward the shoulder to produce a yieldable biasing force between the shoulder and the end portion of the arm so that axial vibration of the vibratory member produces flexure of the arm and consequent rotation of the rotary member. One display device comprises a rotary hub frictionally driven by such rotary member and rotatably mounted around the cylindrical surface of the vibratory member, at least one mobile display element positioned outwardly from the rotary hub, and a flexible resilient spoke-like connecting element extending between the rotary hub and the mobile display element for causing such element to rotate with the rotary hub while affording flexibility therebetween.

52 Claims, 43 Drawing Figures

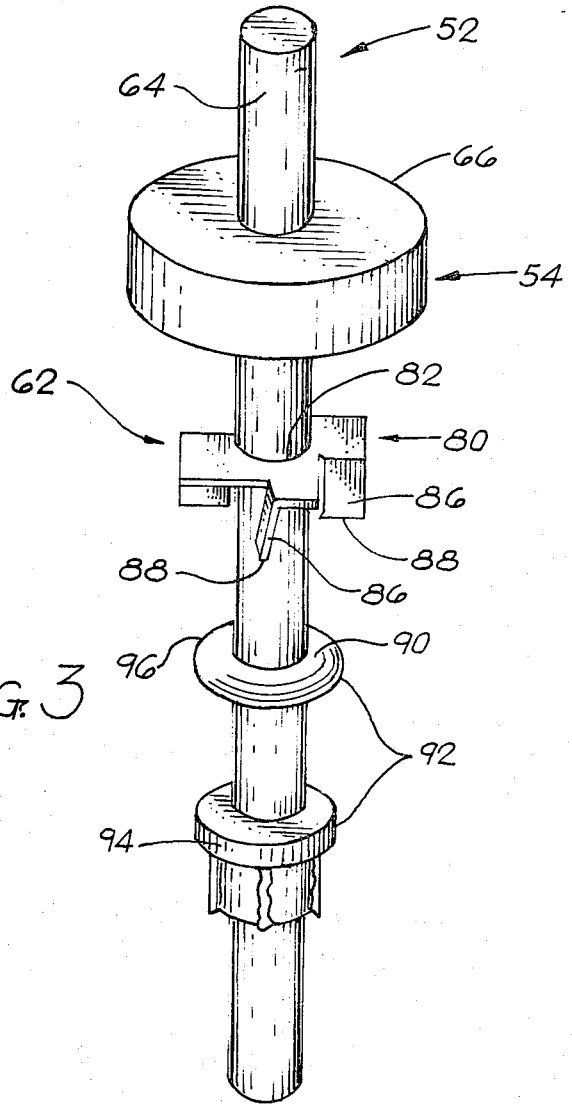
FIG. 3
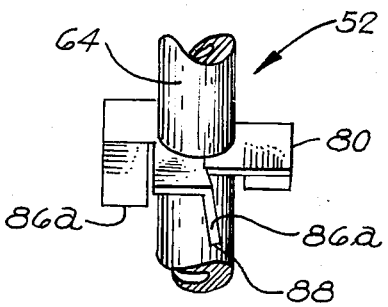
FIG. 4
FIG. 8
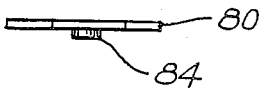
FIG. 7
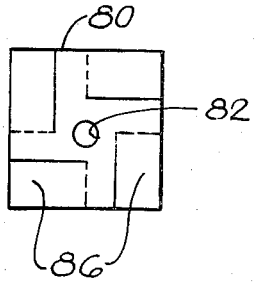
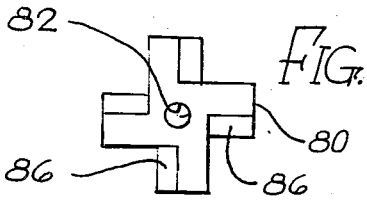
FIG. 5
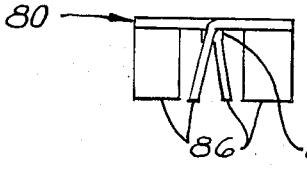
FIG. 6

252
258
260
262
254
29
28
52
54
62
264
274
66
68
70
256
250
272
268
266
276
270

FIG. 37
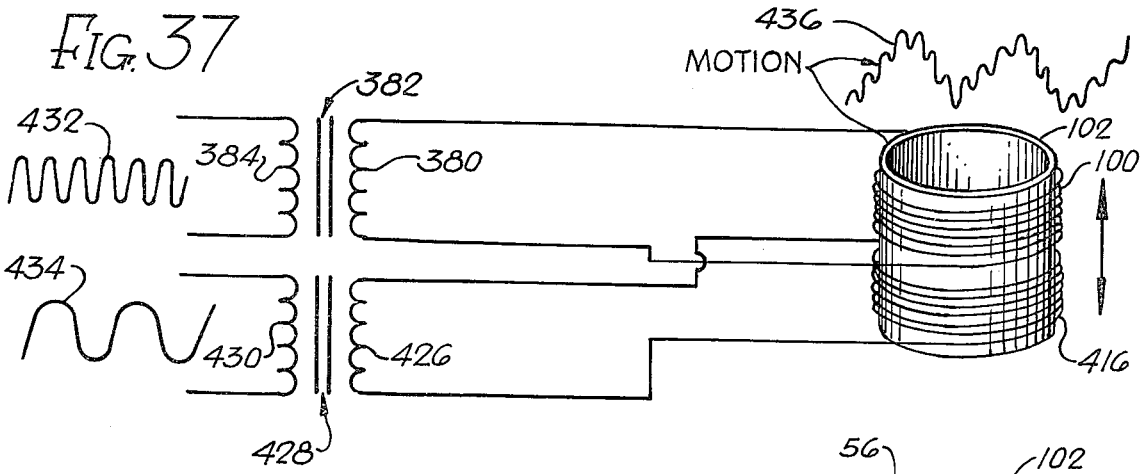
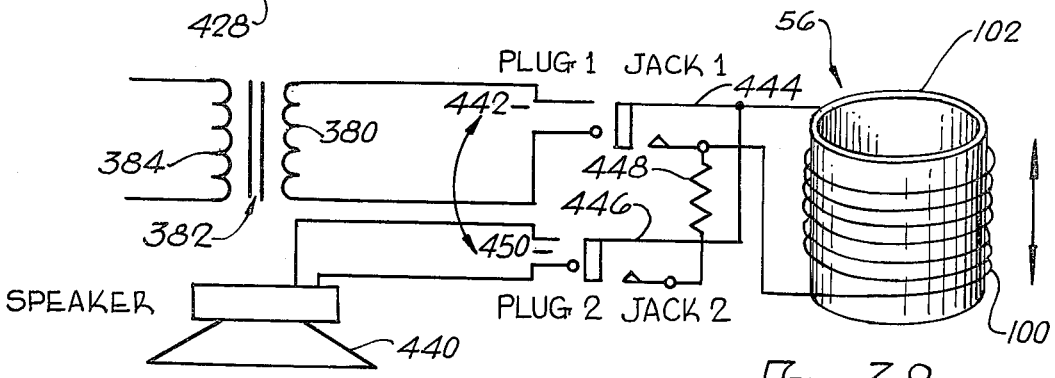
FIG. 38
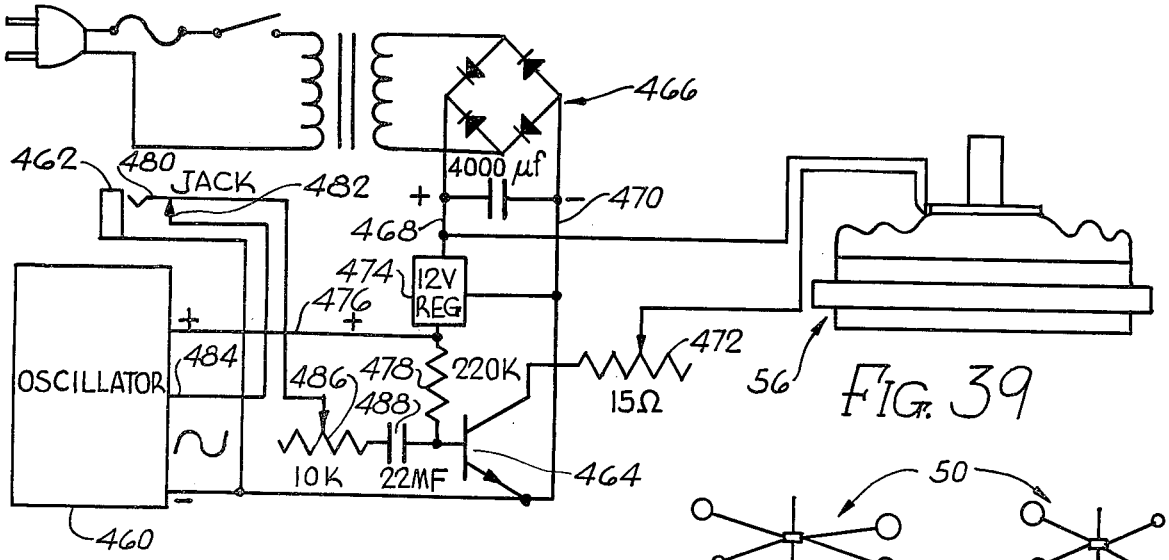
FIG. 39
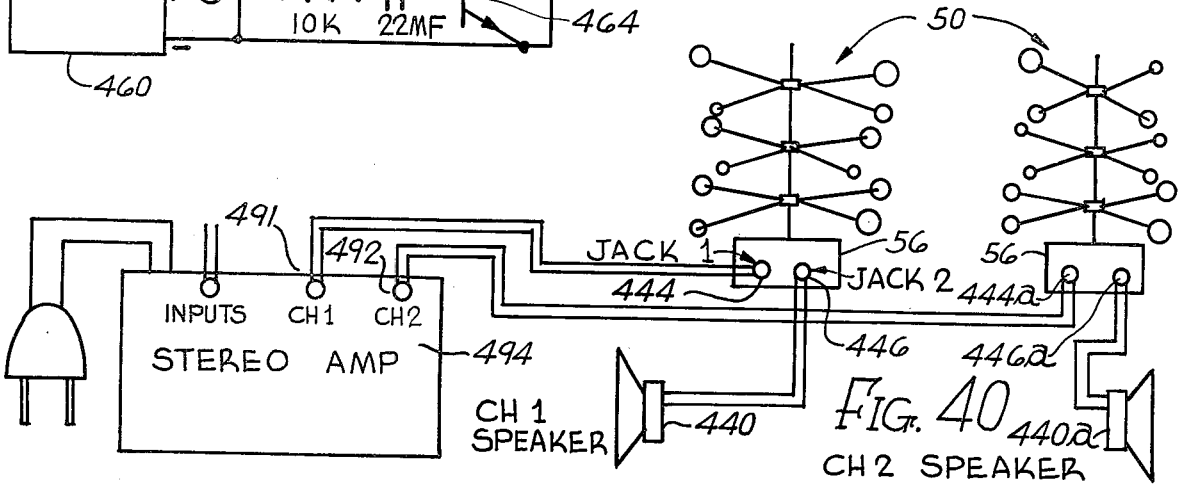
FIG. 40

VIBRATORY-ROTARY MOTION CONVERTERS AND DISPLAY DEVICES INCORPORATING SUCH CONVERTERS

This invention relates to motion converting devices for converting vibratory motion into rotary motion, and also relates to display devices incorporating such motion converting devices.

One object of the present invention is to provide a new and improved motion converting device for converting vibrations, such as those associated with music and other sounds, into rotary motion which incorporates the rhythms and pulsations of the music or other sound.

A further object is to provide a new and improved display device having a rotary display including flexibly mounted display elements which are rotated in response to the rhythms and pulsations of the music or other sound.

Another object is to provide a new and improved display device in which light is modulated by variegated wheels which are rotated in response to the rhythms and pulsations of the music or other sound, the light also being modulated by the vibrations of a light transmitting liquid to which the vibrations of the music or other sound are imparted.

To achieve these and other objects, the present invention may provide a device for converting vibratory motion into rotary motion, comprising a vibratory member having a generally cylindrical external surface, supporting means for supporting the vibratory member for axial vibratory motion along the cylindrical axis of such surface, vibration producing means for causing such axial vibratory motion of the vibratory member, a rotary member slidably and rotatably mounted around the cylindrical surface of the vibratory member for rotary motion relative thereto about such cylindrical axis, a shoulder member on the vibratory member and having a shoulder facing toward the rotary member, and at least one flexible resilient arm on the rotary member and having an end portion extending toward the shoulder for engagement therewith, such arm being oriented for flexing motion in a direction such that the end portion of the arm has axial and circumferential components of motion relative to such cylindrical axis, the rotary member being biased toward the shoulder to produce a yieldable biasing force between the shoulder and the end portion of the flexible arm so that axial vibration of the vibratory member produces flexure of such arm and consequent rotation of the rotary member.

The invention also provides a mobile display device, including a rotary hub rotatably mounted around the cylindrical surface of the vibratory member for rotary motion about such cylindrical axis, at least one mobile display element positioned outwardly from the rotary hub, and a flexible resilient connecting element forming a flexible resilient connection between the rotary hub and the mobile display element for causing it to rotate with the rotary member while affording flexibility therebetween.

In addition, the invention may provide a device for producing a display of modulated light, comprising a light-modulating wheel rotatable with the rotary member about such cylindrical axis, at least one light source for directing light upon the wheel, such wheel being variegated for producing modulation of the light, a cell containing a light-transmitting liquid for receiving modulated light from the wheel, a vibratory connection between the vibratory member and such cell for producing vibratory motion of such liquid in response to the vibratory motion of the vibratory member, the vibratory motion of the liquid producing vibratory modulation of the light from such wheel, and image producing means for receiving the light from such liquid and producing images which are modulated by the rotary motion of the wheel and the vibratory motion of the liquid.

Further objects, advantages and features of the present invention will appear from the following description, taken with the accompanying drawings, in which:

FIG. 3 is an enlarged partially disassembled view of such motion converter.

FIG. 4 is a fragmentary perspective view, showing a modified rotary element for the motion converter, adapted to produce rotation in the opposite direction from that produced by the device of FIG. 3.

FIGS. 5 and 6 are plan and elevational views of the rotary converter element for the device of FIG. 3.

FIGS. 7 and 8 are plan and elevational views of a sheet metal blank for the rotary converter element of FIGS. 5 and 6, before the flexible arms are struck downwardly from the blank.

FIG. 37 is a circuit diagram showing a modified driver circuit for two coils.

FIG. 38 is a circuit diagram showing a modified circuit for driving a transducer coil or a loudspeaker or both.

FIG. 39 is a diagram of a circuit in which an oscillator is employed to drive a transducer.

FIG. 40 is a diagram of a circuit in which two rotary display devices are driven by the two channels of a stereo amplifier.

Figure 1:
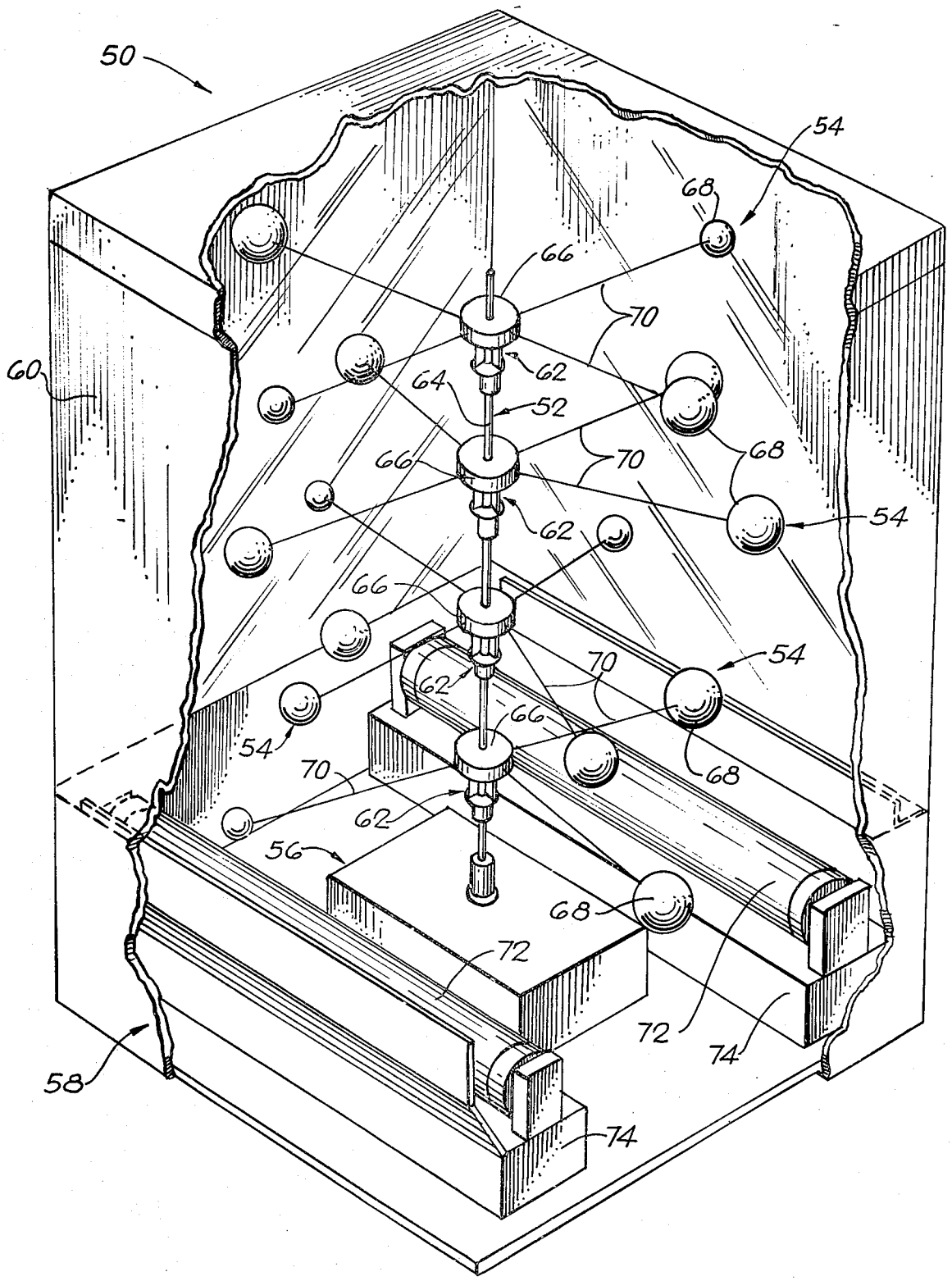
FIG. 1 is a perspective view of a rotary display device to be described as an illustrative embodiment of the present invention.
Figure 2:
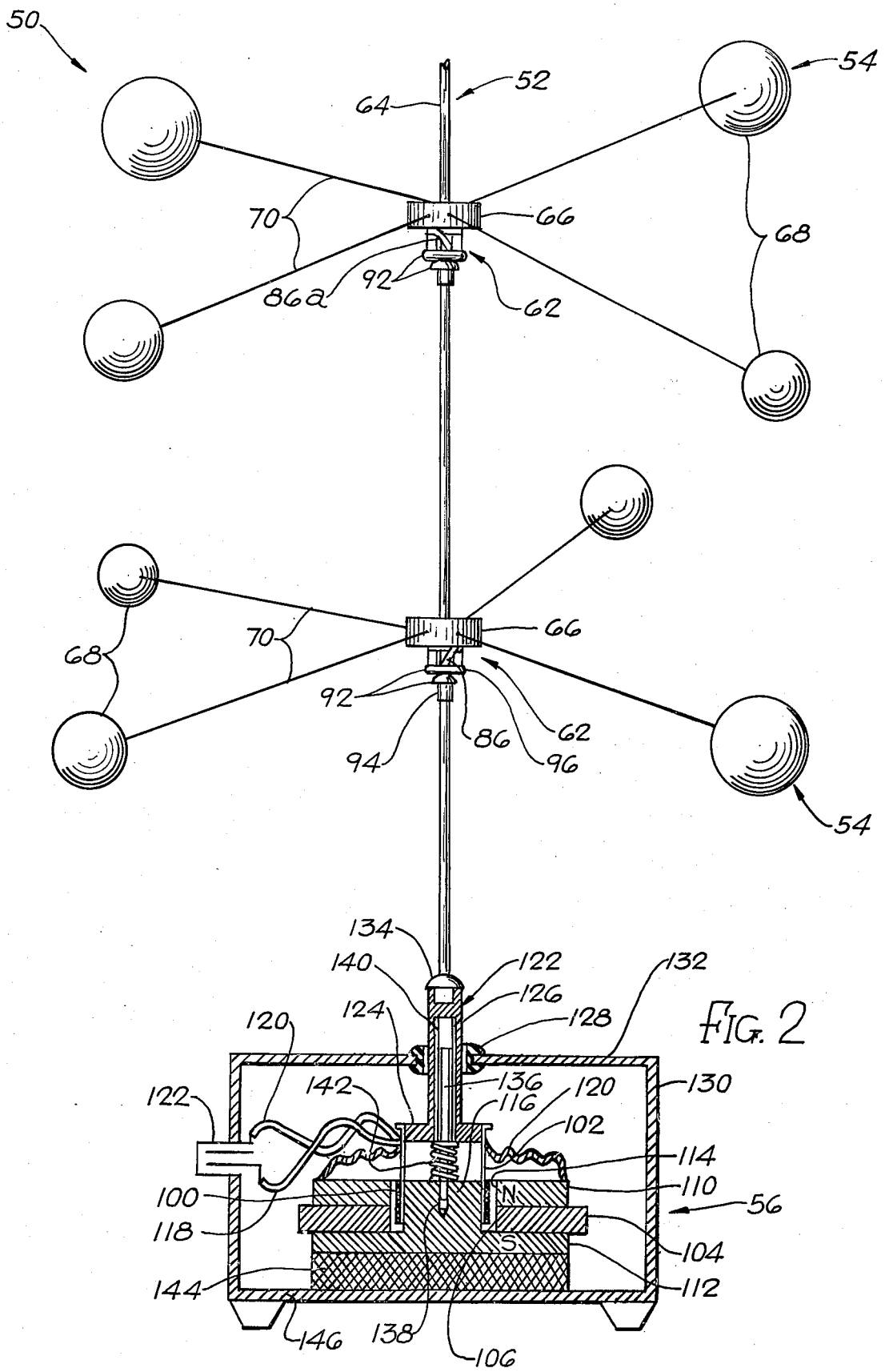
FIG. 2 is a fragmentary elevational section of the working portion of the rotary display device, illustrating certain details of the vibratory-rotary motion converter which is incorporated in the display device.

As just indicated, FIGS. 1 and 2 illustrate an embodiment of the present invention in the form of a mobile display device 50, in which the axial vibratory motion of a vibratory member 52 is converted into the rotary motion of one or more rotary display members 54, four such members being shown in the present case. The axial vibration of the vibratory member 52 is produced by a transducer 56 which translates electrical signals into the vibratory motion of the member 52. The electrical signals supplied to the transducer 56 may represent music or other sounds and may be derived from the output of a radio, record player, tape player or the like. The rotation of the rotary display members 54 will thus respond to the rhythms, pulsations and variations of the music or other sounds.

The mobile display device 50 may have a protective housing 58, at least a portion of which is preferably transparent, to reveal the rotary display members 54. In this case, the housing 58 has a transparent upper portion or cover 60.

The rotation of the rotary display members 54 is produced by vibratory-rotary motion converters 62 which convert or translate the axial vibratory motion of the vibratory member 52 into rotary motion of the members 54. The motion converters 62 may be all the same, or may differ slightly, so as to rotate some of the rotary members 52 clockwise, while rotating other members counterclockwise.

The vibratory member 52 has an external cylindrical surface 64, about which the rotary display members 54 are mounted, for rotation about the cylindrical axis of such surface. More specifically, the vibratory member 52 is preferably in the form of a cylindrical rod or shaft which may be either solid or tubular, preferably tubular, to reduce the weight of the vibratory member. Preferably, the vibratory member 52 is mounted in a vertical position so that the rotary display members 52 will be rotatable about a vertical axis.

In this case, each of the rotary display members 52 comprises a rotary hub 66 which is rotatably mounted on the vibratory member 52. At least one display element or body 68 is positioned outwardly from the rotary hub 66. A connecting element 70 is provided between the hub 66 and the corresponding display element 68. In this case, each rotary display member 54 includes a plurality of display elements or bodies 68 which are spaced at intervals around the rotary hub 66. A connecting element 70 is provided between each of the display elements 68 and the hub 66. Each of the illustrated rotary display members 54 includes four such display elements 68 and connecting elements 70. Preferably, each of the connecting elements 70 is flexible and resilient so that the corresponding display element 68 is supported in a resilient manner and is able to respond to the rhythms and pulsations of the musical or other vibrations of the vibratory member 52.

As shown, each connecting element 70 is in the form of a length of slender flexible and resilient wire, connected at its opposite ends to the rotary hub 66 and the display element 68. Each connecting element 70 may be made of spring wire, such as piano wire, for example. Each wire element 70 is preferably painted black to reduce its visibility, so that the display element 68 will appear to float in space.

The display elements 68 may assume various forms. As shown, the display elements 68 are in the form of spheres or balls, but they may be in any other desired form, such as the shape of stars, birds, aircraft, spacecraft or geometrical figures, for example. The possibilities are limitless. The display members 54 may be provided with lettering, printed messages, emblems, pictures, surface decorations, or any other desired surface treatment. Interesting and attractive visual effects may be produced by illuminating the display elements 68 with ultraviolet light and by providing fluorescent materials at least on the surface of some or all of the display elements 68. The ultraviolet light may be provided by the illustrated lamps 72 which are mounted in fixtures 74. Each illumination by ultraviolet or black light will produce brilliant fluorescence of the display elements 68 while making the connecting element 70 virtually invisible, so that the display elements 68 will appear to float in space.

The display elements 68 are preferably made of a lightweight material, such as polystyrene foam, for example. In many cases, the display elements 68 can be mounted on the supporting wires 70 by simply impaling the display elements 68 on the outer ends of the wires 70.

While the rotary hubs 66 may be made of a variety of materials, the hubs are preferably made of a lightweight material, such as polystyrene foam, for example. In many cases, the flexible resilient wires 70 can be secured to the hubs 66 by simply forcing the inner ends of the wires 70 into the hubs 66 so that the hubs will be impaled on the wires. If desired, an adhesive material may be employed to bond the wires 70 to the hubs 66, and also to the display elements 68. Any other suitable means may be employed to secure the connecting wires 70 to the hubs 66 and the display elements 68.

Additional details of the vibratory-rotary motion converting devices 62 are shown in FIGS. 2–9. As previously indicated, the transducer 56 produces axial vibratory motion of the rod-like vibratory member 52. The motion converting devices 62 convert such vibratory motion into rotary motion of the rotary display members 54, about the cylindrical axis of the vibratory member 52.

As shown in FIGS. 2 and 3, each vibratory-rotary motion conversion device may comprise a rotary converter element 80 which frictionally drives the hub 66 of the rotary display member 54. The rotary converter element 80 is rotatably and slidably mounted around the external cylindrical surface 64 of the vibratory member 52. As shown, the rotary converter element 80 has a bearing opening 82 which slidably and rotatably receives the cylindrical surface 64. As shown, the rotary converter element 80 is thin and plate-like in shape and is formed with an extruded bearing portion 84 which provides the bearing opening 82. The rotary converter element 80 is made of a flexible resilient material, preferably sheet metal, of a springy character, such as spring steel, brass or bronze, or the like. The rotary converter element 80 may also be made of a flexible resilient resinous plastic material.

The rotary converter element 80 has at least one flexible resilient arm 86 which is preferably formed in one piece therewith. A plurality of such flexible resilient arms 86 may be formed on the rotary converter element 80, which has four such arms in this case, spaced around the element 80 at equal angular intervals.

Each flexible arm 86 has an end portion 88 which extends toward and is engageable with an annular shoulder 90 formed by a shoulder member 92 on the vibratory member 52. In this case, the shoulder member 92 comprises two components: a bushing 94 which is crimped or otherwise secured to the vibratory member 52, and a soft resilient ring 96 which is tightly fitted around the cylindrical surface of the vibratory member 52 and is supported by the upper end of the bushing 94. The ring 96 may be in the form of an O-ring, made of synthetic rubber or some other rubber-like material.

The end portion 88 of each flexible resilient arm 86 is yieldably biased against the shoulder 90. In this case, such biasing action is produced by gravity, in that the weight of the rotary converter element 80 and the rotary display member 54 produces a gravitational biasing force between the shoulder 90 and the end portion 88 of the flexible arm 86. If desired, the gravitational biasing action could be augmented by a spring biasing action.

Each flexible resilient arm 86 is oriented for flexing motion in a direction such that the end portion 88 of the arm has axial and circumferential components of motion relative to the cylindrical axis of the vibratory member 52. The axial vibration of the vibratory member 52 produces such flexure of the arm 86. Due to the circumferential components of such flexing motion, a rotary motion is imparted to the rotary converter element 80. The frictional engagement between the rotary converter element 80 and the hub 66 of the rotary display member 54 produces a frictional coupling effect, so that the hub 66 is rotated. The frictional coupling is considerably enhanced when the vibratory member 52 is being moved upwardly during its vibratory cycle, because the gravitational force between the hub 66 and the rotary converter element is augmented by the force required to accelerate the hub 66 upwardly. Consequently, the hub 66 is rotated in one direction only, corresponding to the direction of circumferential movement of the rotary converter element 80 when the vibratory member 52 is moved upwardly during the vibratory cycle. The flexure of the arm 86 and the consequent circumferential movement of the upper portion of the arm are diagrammatically illustrated in FIG. 9. It will be understood that the flexure of the arm 86 is exaggerated for clarity of illustration. During the upward vibratory movement of the shoulder 90 on the vibratory member 52, the end portion 88 of the arm 86 remains in engagement with the shoulder 90, so that the flexure of the arm 86 produces circumferential movement of the upper portion of the arm to the right, as viewed in FIG. 9. Corresponding rotary motion is imparted to the hub 66 of the rotary display member 54.

Thus, the vibratory-rotary motion converter 62 of FIG. 3 causes the hub 66 of the rotary display device 54 to rotate in a counterclockwise direction, as viewed from the top. This direction of rotation is related to the orientation or direction of the flexible resilient arms 86 on the rotary converter element 80. In the construction of FIG. 3, each arm 86 is folded or bent downwardly from the plate-like converter element 80, so that the arm 86 is at an inclined angle between axial and perpendicular directions, relative to the cylindrical axis of the vibratory member 52. The bend line between the arm 86 and the main body of the rotary element 80 is along a generally radial line.

The direction of rotation of the hub 86 can be reversed by reversing the angle of inclination, as illustrated in the modified construction of FIG. 4. In this case, the rotary converter element 80 has slightly modified flexible resilient arms **86*a* which are bent down at an inclined angle to the right, rather than to the left, as in FIG. 3. Consequently, the modified construction of FIG. 4 is adapted to produce clockwise rotation of the rotary hub 86**, as viewed from the top, rather than counterclockwise rotation.

In the mobile display device 50 of FIGS. 1 and 2, two of the motion converting devices 62 are preferably constructed to produce counterclockwise rotation of the corresponding rotary display members 54, while the other two motion converting devices 62 are preferably constructed to produce clockwise rotation. The opposite directions of rotation are preferably alternated. In FIG. 2, the lower rotary display member 54 is preferably rotated in a counterclockwise direction, while the upper member 54 is preferably rotated in a clockwise direction.

As illustrated in FIGS. 7 and 8, the rotary converter element 80 may be formed from a flat blank, made of sheet metal, such as spring steel or phosphor bronze, for example. The bearing 84 is extruded from the blank in one direction. The flexible arms 86 are struck or stamped from the blank and folded in the same direction to their inclined positions. The same blank can be used to produce both types of rotary converter elements, for producing left hand and right hand rotation, by reversing the direction in which the bearing 84 is extruded, and in which the flexible arms 86 are bent or folded.

As previously indicated, the rotary converter element may have one or more of the flexible arms 86. The converter 80 of FIGS. 3–8 has four such arms 86.

Figure 14:
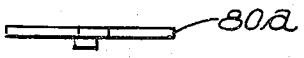
FIGS. 13 and 14 are plan and elevational views of the sheet metal blank for the rotary motion converter of FIGS. 11 and 12.
Figure 13:
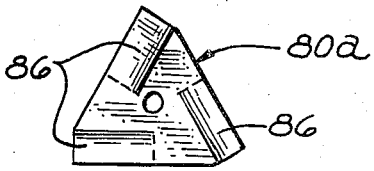
Figure 11:
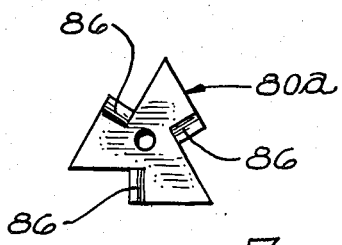

FIGS. 11–14 illustrate a modified rotary converter element 80*a* having only three such flexible resilient arms 86. As shown in FIGS. 13 and 14, the modified converter element 80*a* may be formed from a flat sheet metal blank.

Figure 18:
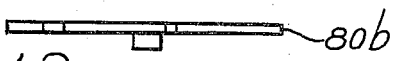
FIGS. 17 and 18 are plan and elevational views of the sheet metal blank for the rotary converter element of FIGS. 15 and 16.
Figure 17:
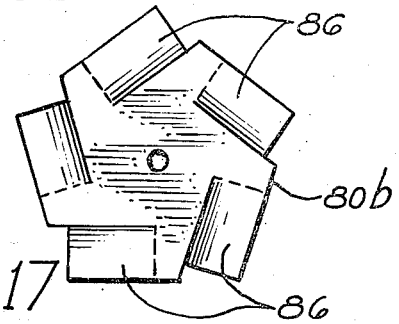
Figure 15:
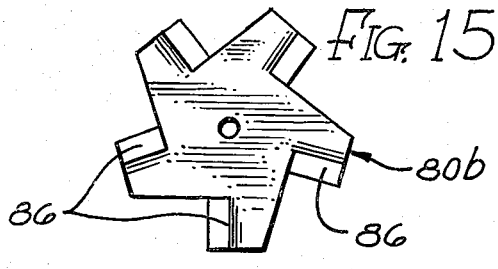
FIGS. 15 and 16 are plan and elevational views of another modified rotary converter element having five flexible arms.
Figure 16:
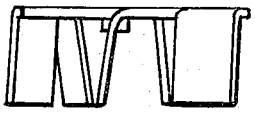

FIGS. 15–18 illustrate another modified rotary converter element 80*b* having five of the flexible resilient arms 86, spaced at equal angular intervals. Again, the arms 86 may be folded from a flat blank, as illustrated in FIGS. 17 and 18.

Illustrative details of the transducer 56 are shown in FIG. 2. The transducer 56 is adapted to translate electrical signals into axial vibrations of the vibratory member 52. In this case, the transducer 56 is advantageously of the electromagnetic type, but it may be of any known or suitable type.

As shown in FIG. 2, the transducer 56 comprises an electrical coil 100 which is in the form of a cylindrical solenoid and is secured to a tubular cylindrical support or form 102. The coil 100 is positioned in a radial magnetic field, produced by a ring-shaped permanent magnet 104 formed with a cylindrical opening 106 in which the lower portion of the coil 100 is positioned. The permanent magnet 104 has north and south poles on its opposite flat surfaces, which face upwardly and downwardly in this instance. The permanent magnet 104 is bonded or otherwise secured between upper and lower pole pieces 110 and 112. The upper pole piece or member 110 is formed with a cylindrical opening 114 in which the upper portion of the electrical coil 100 is positioned. The lower pole piece or member 112 has an upwardly projecting cylindrical pole or core 116 which extends within the cylindrical coil form 102. Thus, radial lines of magnetic force or flux are produced between the outside of the cylindrical pole 116 and the inside of the cylindrical opening 114.

With the transducer construction of FIG. 2, any electrical current in the electrical coil 100 interacts with the radial magnetic field to produce an axial force on the coil 100. Electrical currents may be supplied to the coil 100 by flexible leads 118 and 120 which extend from the coil 100 to an electrical connector 122. If alternating current electrical signals are supplied to the connector 122 from the output of a radio, record player, tape player or the like, corresponding vibratory motion of the coil 100 and the coil form 102 will be produced.

The vibratory member 52 is axially mounted on the coil form 102 and thereby is supported for axial vibratory motion with the coil 100 and the coil form 102. The cylindrical outer surface of the pole or core 116 and the cylindrical openings 106 and 114 form an annular air gap in which the coil 100 and the coil form 102 are centered, so that the coil and the coil form are freely movable in an axial direction, without touching the core 116, the magnet 104 and the upper pole piece 110. The central alignment of the coil form 102 is maintained by a highly flexible annular spider or diaphragm 120, connected between the coil form 102 and the upper pole piece 110.

A connecting member 122 is provided to connect the lower end of the rod-like vibratory member 52 to the upper end of the coil form 102. The lower end of the connecting member 122 is formed with an annular flange 124 which is secured within the upper end of the coil form 102. The upper portion of the connecting member 122 is in the form of a hollow cylindrical bushing or stem 126 which is guided for axial motion by a stationary low friction bushing 128, which may be made of silicone rubber or the like. The illustrated transducer 56 has a housing 130 with an upper wall 132 in which the bushing 128 is mounted.

In this case, the lower end of the rod-shaped vibratory member 52 is clamped or otherwise secured in the upper end of the hollow cylindrical stem 126, as by means of a clamp 134 which is pressfitted into the upper end of the stem 126.

It is preferred to provide additional means to guide the connecting member 122 for axial vibratory motion. As shown in FIG. 2, such guidance is provided by a guide pin 136 which projects axially in an upward direction from the upper end of the pole or core 116. Such axial guide pin 136 is pressfitted into or otherwise secured in an axial opening 138 formed in the upper end of the core or pole 116. The upper portion of the guide pin 136 is freely slidable within a low friction bushing 140, secured within the hollow connecting member 122.

If desired, a counterbalancing spring 142 may be provided around the pin 136 between the upper end of the pole 116 and the lower end of the connecting member 122, to counterbalance the weight of the vibratory member 52 and the various components connected thereto, including particularly the rotary display member 54. In some cases, the spider 120 provides sufficient support, so that the spring 142 is not needed.

In FIG. 2, a sound absorbing pad 144 is provided to support the lower pole piece or member 112 of the transducer 56, to minimize the transmission of sound to the lower wall 146 of the housing 130.

Figure 19:
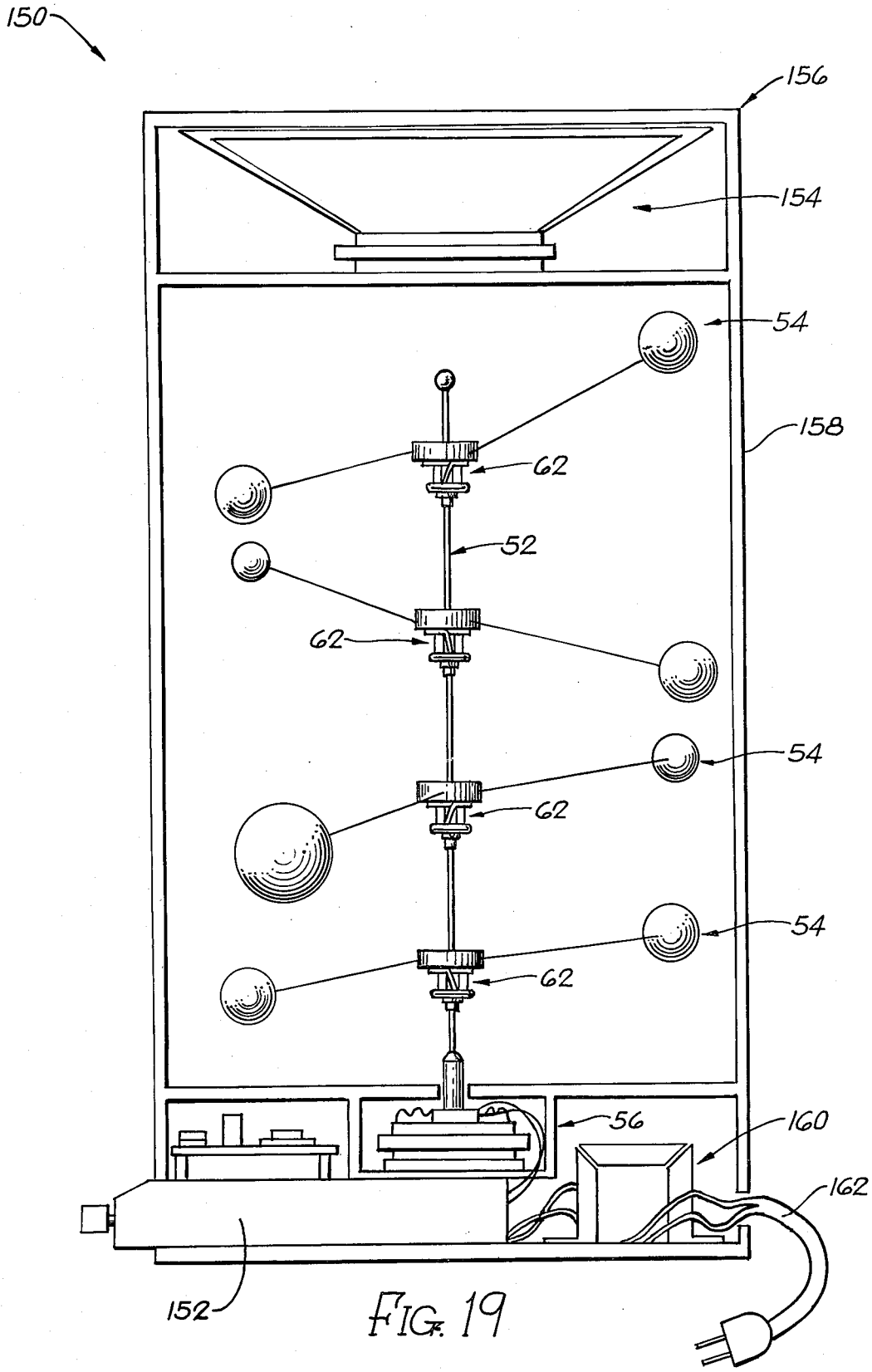
FIG. 19 is a diagrammatic elevational section showing a modified rotary display device incorporating a radio for producing vibrations derived from music or other sounds.

FIG. 19 illustrates a slightly modified mobile display device 150 which incorporates a radio 152 to provide alternating current electrical signals which are translated into vibratory motion by the transducer 56. Thus, the rotary display devices 54 respond to the rhythms and pulsations of the music or other sound from the radio 152. The display device 150 incorporates a loud speaker 154 which is connected to the output of the radio 152. In this case, the loud speaker 154 is mounted in the upper portion of a modified housing 156, having a transparent portion 158 around the rotary display devices 54. The radio 152 may have a power supply 160 with a power cord 162, adapted to be plugged into a conventional alternating current outlet.

Otherwise, the modified display device 150 may be essentially the same as the previously described display device 50 of FIGS. 1 and 2.

Figure 20:
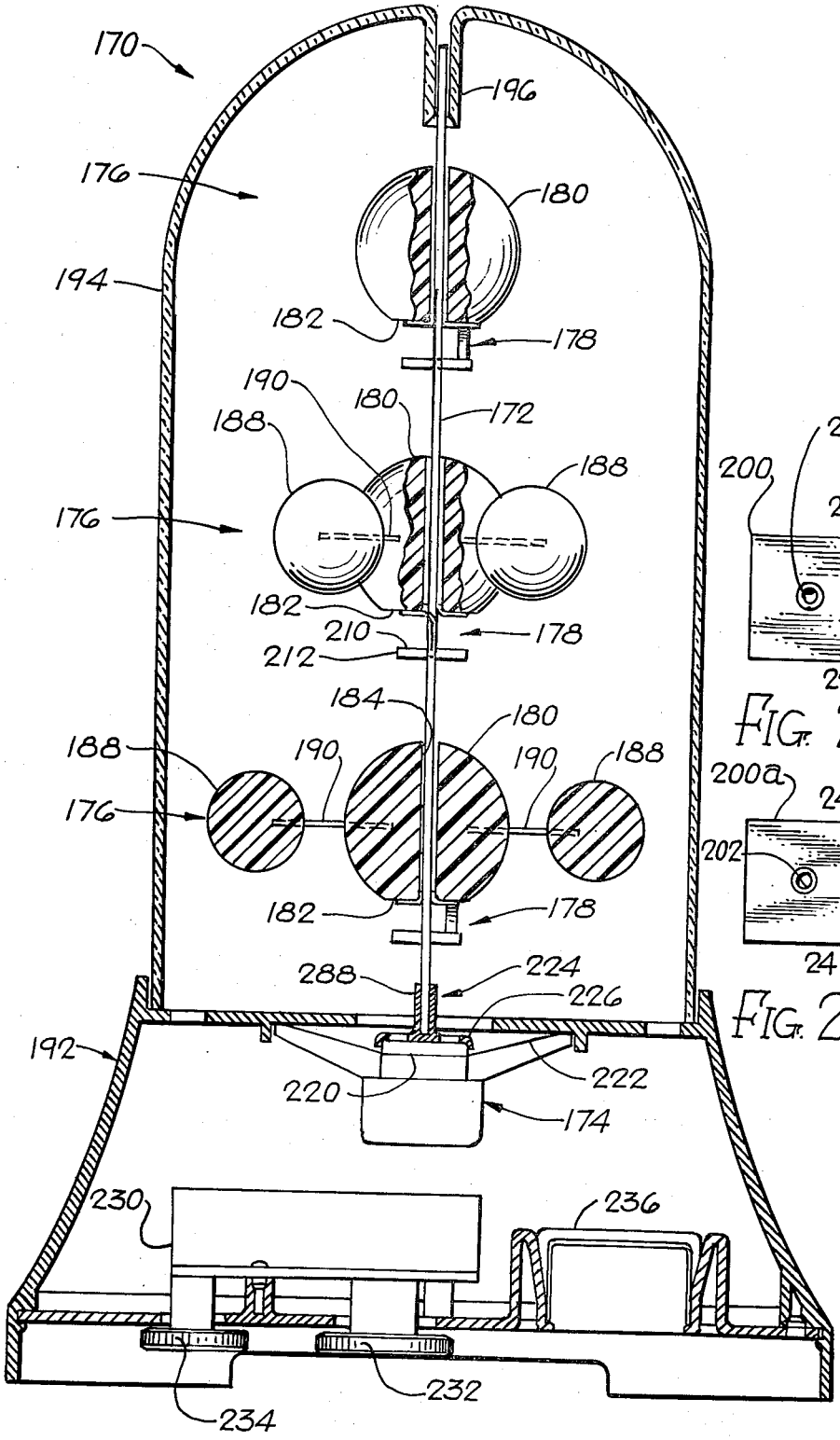
FIG. 20 is a diagrammatic elevational section illustrating another modified rotary display device, including a modified vibratory-rotary motion converter.

FIG. 20 illustrates another modified mobile display device 170 which is similar to the previously described display devices 50 and 150, with some differences in detail. Thus, the display device 170 comprises a generally cylindrical vibratory member 172 which is rod-like in shape and may be either solid or tubular. A transducer 174 is provided to translate electrical signals into axial vibratory motion of the rod-like member 172. The transducer 174 may be essentially the same in construction and operation as the transducer 56, as previously described, or may be modified, as will be described presently.

One or more rotatable display members 176 are mounted on the cylindrical vibratory member 172. In this case, there are three such rotary display member 176. Each member 176 is provided with a vibratory-rotary converting device 178 for converting the axial vibratory motion of the cylindrical member 172 into rotary motion of the display device 176.

The rotary display devices 176 are similar to the devices 54 as previously described. Such, each rotary display device 176 comprises a hub member 180 which in this case is generally spherical in shape, but with a flat lower surface. The hub 180 has an opening 184 in which the cylindrical vibratory member 172 is slidably and rotatably received. As to the two lower rotary display devices 176, each device includes a display element or body 188 which is connected to the hub 180 by a flexible resilient connecting wire 190. Preferably, each rotary display device 176 comprises a plurality of the display elements 188 and the flexible resilient connecting elements 190. These elements 188 and 190 are similar to the elements 68 and 70, previously described.

The modified display device 170 of FIG. 20 has a modified housing 192, including a generally dome-shaped upper member 194 which is transparent. In this case, the upper portion of the dome-shaped housing member 194 is formed with a downwardly projecting guide sleeve 196 in which the upper end of the vibratory member 172 is slidably guided.

The vibratory-rotary motion converting devices 178 are slightly modified in construction, as shown in FIGS. 20–24. Each motion converting device 178 comprises a rotary converter element 20 which is preferably plate-like in shape and is formed with a bearing opening 202, slidably and rotatably receiving the cylindrical vibratory member 172. The bearing opening 202 is formed within an extruded bearing 204, formed from the rotary element 200.

Each rotary converter element 200 has a flexible resilient arm 206 with an end portion 208, extending toward a shoulder 210, formed by an annular shoulder member 212 secured to the cylindrical vibratory member 172. In this case, the shoulder member 212 is simply in the form of an annular disc, which may be made of a resinous plastic material, which may be cemented, boneded or otherwise secured to the vibratory member 172. The shoulder member 212 may also be made of synthetic rubber, metal or any other suitable material.

In this case, the rotary converter element 200 has only a single flexible arm 206, but more than one may be provided, if desired. The rotary element 200 is preferably made in one piece from a flat sheet metal blank, made of spring steel or phosphor bronze, for example, The flexible arm 206 is struck from the flat blank and is bent or otherwise formed downwardly, so that a bend 214 is provided between the flat body of the element 200 and the end portion 208 of the flexible arm 206. With this construction, the flexible arm 206 has both axial and circumferential components of flexing motion, as previously described in connection with the flexible resilient arm 86.

In each motion converting device 176, the hub member 180 is frictionally driven by the rotary converting element 200. Thus, the flat plate-like body of the element 200 engages the flat lower surface 182 of the hub member 180. In this case, the extruded bearing 202 on the rotary converter element 200 projects upwardly and is received in the lower end portion of the opening 182 in the hub member 180. The flexible resilient arm 206 projects downwardly, opposite from the direction of the extruded bearing 202, and toward the corresponding shoulder 210.

Figures 21, 22:
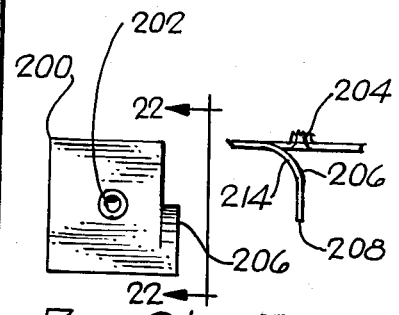
FIGS. 21 and 22 are plan and elevational views of one of the rotary converter elements employed in the device of FIG. 20, FIG. 22 being taken as illustrated by the line 22—22 in FIG. 21.

Each motion converting device 128 translates the axial vibratory motion of the rod or shaft 172 into rotation of the hub member 180 of the rotary display member 176. The direction of such rotation is determined by the construction and orientation of the flexible resilient arm 206 on the rotary converter element 200. As shown in FIG. 22, the flexible arm 206 is bent in such a manner that it extends downwardly and to the right from the converter element 200. This construction results in clockwise rotation of the hub member 180.

Figures 23, 24:
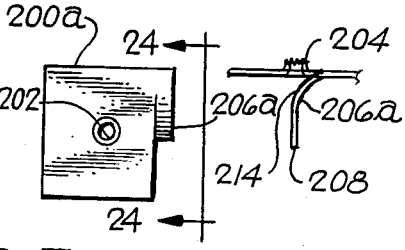
FIGS. 23 and 24 are plan and elevational views of a modified rotary converter element for producing rotation in the opposite direction, FIG. 24 being taken as illustrated by the line 24—24 in FIG. 23.

Rotation in the opposite direction is produced by the modified construction of FIGS. 23 and 24, which illustrate a modified rotary converter element 200*a* having a flexible resilient arm 206*a* which is bent downwardly in the opposite direction, so that the arm 206*a* extends downwardly and to the left from the flat plate-like body of the rotary converter element 200*a*. Otherwise, the element 200*a* is the same as the element 200. The same sheet metal blank can be used in producing both types of elements 200 and 200*a*. To form the element 200, the extruded bearing 202 is formed in the direction shown in FIGS. 21 and 22, while the flexible arm 206 is formed in the opposite direction. To form the element 200*a*, these directions are reversed, as shown in FIGS. 23 and 24.

In the display device 170 of FIG. 20, the three motion converting devices 128 are preferably arranged to produce opposite directions of rotation alternately. Thus, the lowermost and the uppermost motion converting devices 178 may be arranged to produce counterclockwise rotation, while the intermediate motion converting device 178 may be arranged to produce clockwise rotation of the rotary display device 176. Of course, this arrangement can be varied, as desired.

If desired, the transducer 174 of FIG. 20 may be the same as the previously described transducer 56 of FIGS. 1 and 2. However, as illustrated in FIG. 20, the transducer 174 comprises a conventional dynamic loudspeaker having a voice coil member 220 which drives a speaker cone 222. The voice coil member 220 is employed as a vibratory drive member to produce axial vibrations of the vibratory rod or shaft member 172.

Thus, in FIG. 20, the lower end of the vibratory rod 172 is mounted on the voice coil member 220 by means of a support member 224 having a dish-shaped flange 226 which is received and centered over the upper end of the voice coil member 220 and is suitably secured thereto, as by means of a strong bonding adhesive material, for example. The support member 224 also has a hollow upwardly projecting stem or sleeve portion 228, formed in one piece with the flange 226, and adapted to receive the lower end of the vibratory rod or shaft 174 which may be tightly fitted into the sleeve 228 and may also be secured thereto by an adhesive material, if desired.

The display device 170 of FIG. 20 preferably incorporates a radio 230 for producing alternating current electrical signals to be supplied to the transducer 174. Such signals may represent music or other sounds, which are reproduced by the transducer 174, functioning as a combined loudspeaker and vibratory driver for the rod or shaft 172. The axial vibrations of the rod or shaft 172 produce corresponding rotation of the rotary display devices 176, in sympathy with the rhythms and pulsations of the music or other sounds from the radio 230. In this case, the radio 230 has tuning and volume control dials 232 and 234 which are accessible from the underside of the housing 192. Power to operate the radio 230 is provided by a battery 236, removably mounted in the housing 192. The voice dial of the transducer 174 is electrically connected to the output of the radio 230. In other respects, the display device 190 of FIG. 20 may be the same as the previously described display devices, particularly the device 50 of FIGS. 1 and 2.

Figure 25:
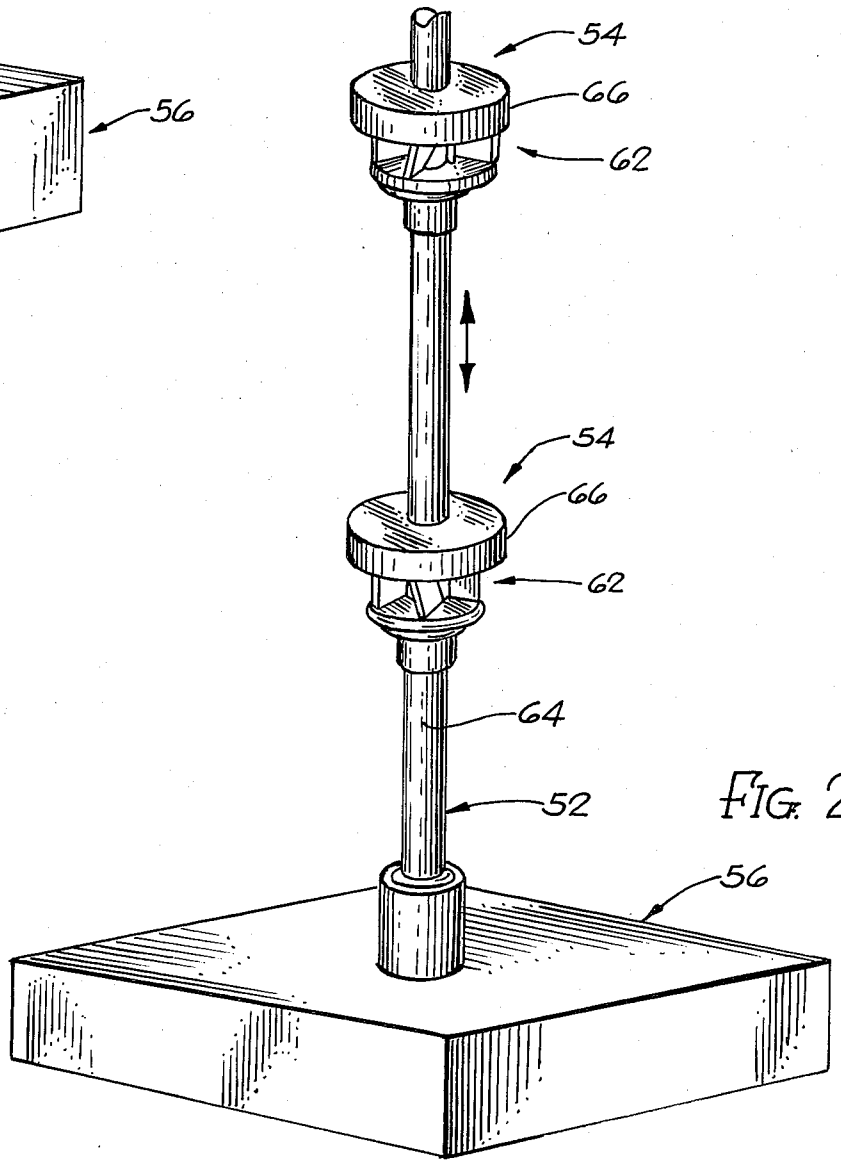
FIG. 25 is a diagrammatic perspective view of a vibratory-rotary motion converter device adapted to be operative in an upright position.
Figure 26:
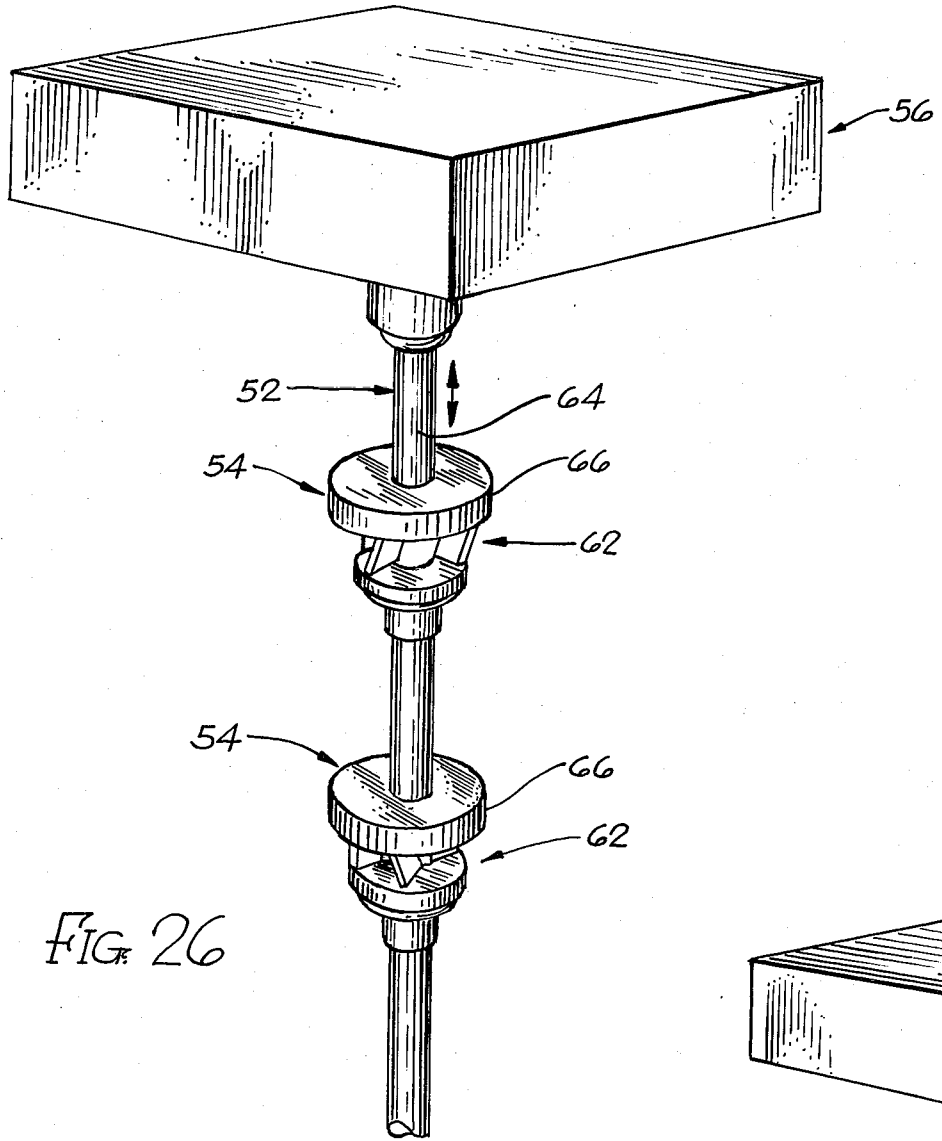
FIG. 26 is a diagrammatic perspective view showing a modified motion converter device, similar to that of FIG. 25, but adapted to be operative in an inverted position.

FIGS. 25 and 26 illustrate the fact that the vibratory rod or shaft 52 of FIGS. 1 and 2 can be driven from either its lower end, as shown in FIG. 25, or its upper end, as shown in FIG. 26. The construction of FIG. 25 is essentially the same as the construction of FIGS. 1 and 2. The lower end of the vibratory shaft 52 is connected to the transducer 56, which produces axial vibratory motion of the shaft 52. Such vibratory motion is converted into rotary motion of the hub members 66 by the vibratory-rotary converting device 62. The rotary display devices 54 are correspondingly rotated.

In the modified construction of FIG. 26, the transducer 56 is inverted and is connected to the upper end of the vibratory shaft 52. As before, the transducer 56 produces axial vibratory motion of the shaft 52, corresponding to the electrical signals supplied to the transducer 56. The operation is otherwise the same as described in connection with FIGS. 1, 2 and 25.

Figures 27, 28, 29:
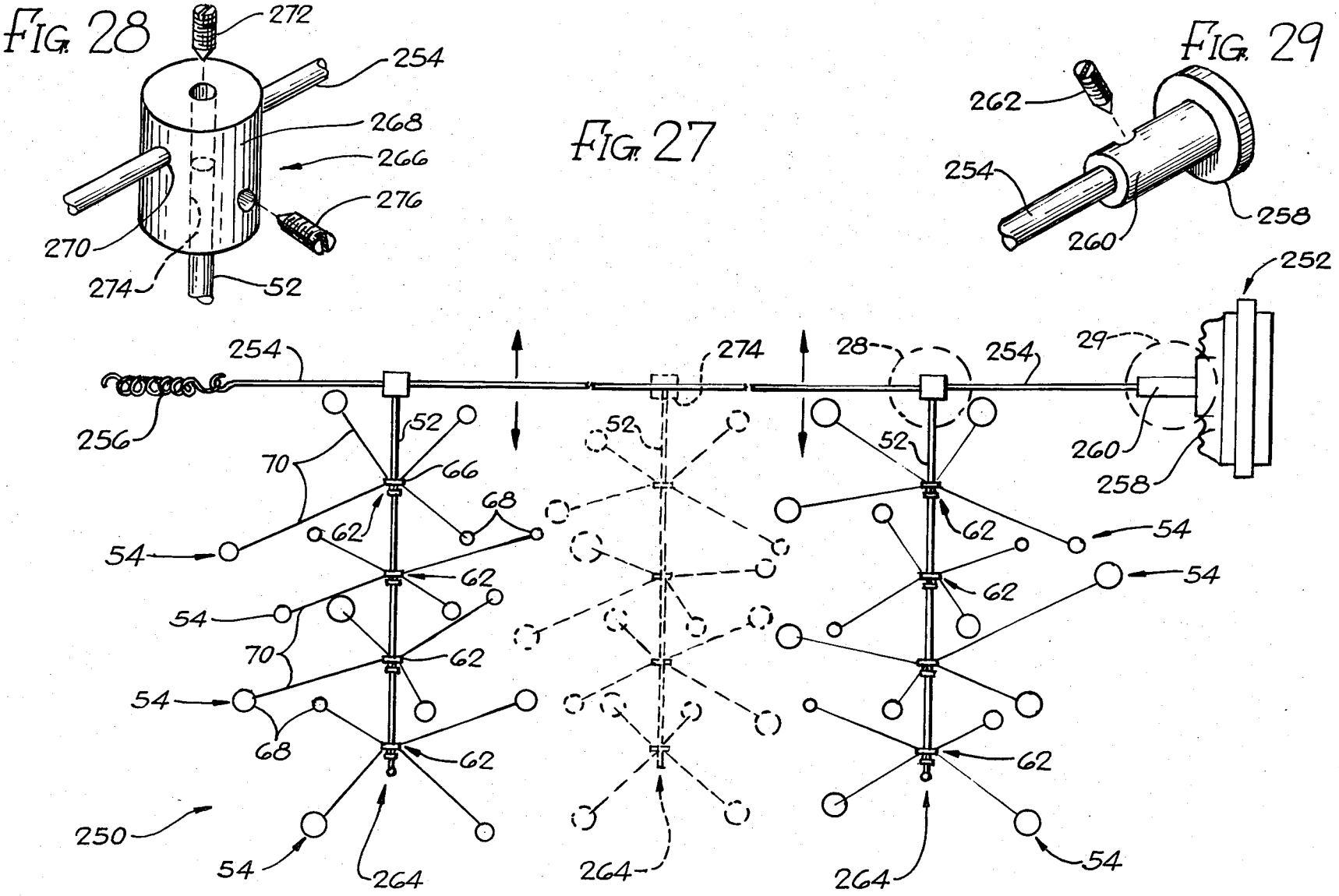
FIG. 27 is a diagrammatic perspective view illustrating a modified display apparatus in which a plurality of rotary display devices are suspended from a vibratory cable or wire.
FIGS. 28 and 29 are fragmentary enlarged perspective views showing details of the apparatus of FIG. 27.

FIGS. 27–29 illustrate a modified display system or apparatus 250, in which horizontal vibrations are converted into vertical vibrations, which are then translated into the rotary motion of rotary display devices 54, the same as illustrated and described in connection with FIGS. 1 and 2. In the display system 250 of FIG. 27, a transducer 252 is employed to produce axial vibratory motion of a horizontal rod or wire 254, which may be strung across a room, for example, or in any other desired location. The transducer 252 may be essentially the same as the transducer 56 of FIGS. 1 and 2. Thus, the transducer 252 is adapted to translate alternating current electrical signals into axial vibrations of the horizontal rod or wire 254. The transducer 252 may be mounted on one wall of a room, or on some other suitable support. One end of the wire 254 is connected to the transducer 252. The other end of the wire 254 is suitably supported so as to produce tension in the wire. As shown in FIG. 27, the opposite end of the wire 254, remote from the transducer 252, is connected to a tension spring 256 which exerts a pull on the wire 254 so as to produce tension therein.

As shown in FIGS. 27 and 29, the transducer 252 has a vibratory coil or other driver member 258 which is connected to the end of the wire 254, as by means of a clamping sleeve 260. A set screw 262 may be employed to retain the end of the wire 254 in the clamping sleeve 260.

The display system 250 of FIG. 27 includes a plurality of display devices 264 which are essentially the same as the corresponding portions of the display device 50 of FIGS. 1 and 2. Each display device 264 is suspended from the wire or rod 254. As in FIGS. 1 and 2, each display device 264 comprises the vibratory rod or shaft 52, on which one or more of the rotary display devices 54 are mounted. The axial vibratory motion of the shaft 52 is converted into rotation of each display device 54 by the vibratory-rotary motion converter 62.

In each display device 264 of FIG. 27, the upper end of the vibratory shaft or rod 52 is suspended from the vibratory wire or rod 254, as by means of a clamping member 266, as shown in FIG. 28. The illustrated clamp 266 comprises a body 268 having a horizontal opening 270 into which the wire or rod 254 is inserted. A set screw 272 may be screwed into the body 268 and clamped against the wire 254 to secure the body to the wire. The upper end of the vibratory shaft 52 is inserted into a vertical opening 274 in the body 266 and is secured therein by the set screw 276, screwed into the body 268.

When electrical signals, representing music or other sounds, are supplied to the transducer 252, the horizontal wire or rod 254 is vibrated axially in a horizontal direction. This varies the tension in the wire 254 and also causes vertical vibratory motion of the wire 254. Such vertical vibratory motion is similar to the vibratory motion of a string in a musical instrument. The vertical vibration of the wire 254 imparts vertical vibratory motion to each of the vibratory shafts 52. As before, the vibratory-rotary motion converting devices 62 translate the axial vibratory motion of the shafts 52 into rotation of the rotary display devices 54. Any suitable number of the display devices 264 may be suspended from the wire or rod 254, so as to produce a complicated and attractive display, involving a multiplicity of the rotary display devices 54.

Figure 30:
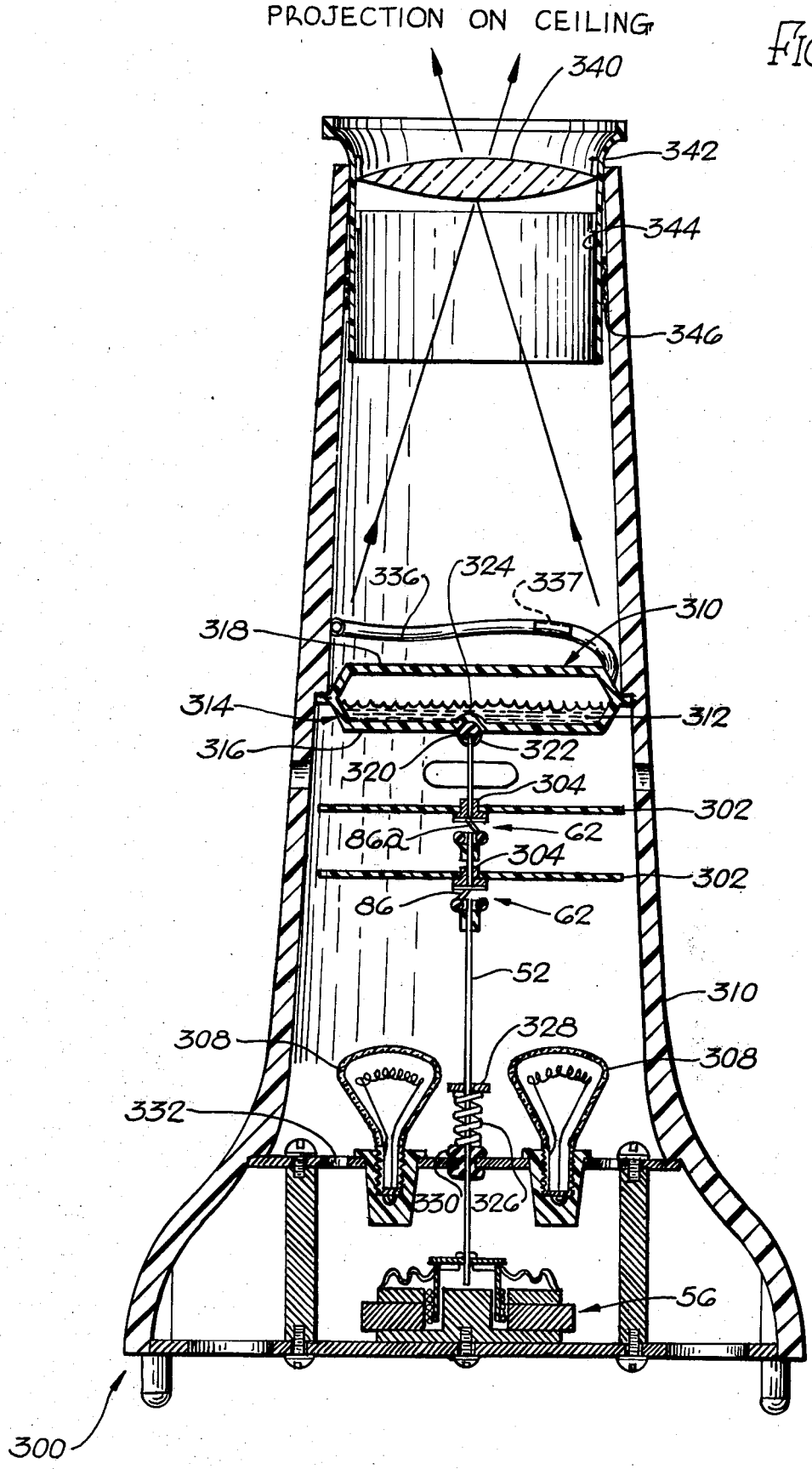
FIG. 30 is a diagrammatic elevational section of a light-modulating display device incorporating vibratory-rotary motion converters, such device being adapted to project images of modulated light on a ceiling.

FIG. 30 illustrates another embodiment of the present invention, in the form of a light-modulating display device 300, which incorporates much of the mechanism of the display device 50 of FIGS. 1 and 2, but produces a display of modulated light, involving ever-changing colors and patterns, in sympathy with the rhythms and pulsations of music or other sounds. The display device 300 of FIG. 30 may include the vertical vibratory rod or shaft 52 of FIGS. 1 and 2, together with the transducer 56, adapted to translate alternating current electrical signals into axial vibratory motion of the shaft 52. The axial vibrations are translated into rotation by the vibratory-rotary motion converting devices 62, as previously described, but the rotation is imparted to modified rotary display devices 302, which may be in the form of light-modulating wheels or discs. In this case, there are two of such wheels 302, which are preferably caused to rotate in opposite directions, by providing right and left hand flexible arms 86 and 86*a* in the two motion converting devices 62, as described in connection with FIGS. 1–9. The light modulating wheels 302 are mounted on rotary hub 304, which are similar to the hub 66 of FIGS. 1 and 2, except that the hubs 304 are adapted to support the wheels 302.

Figure 9:
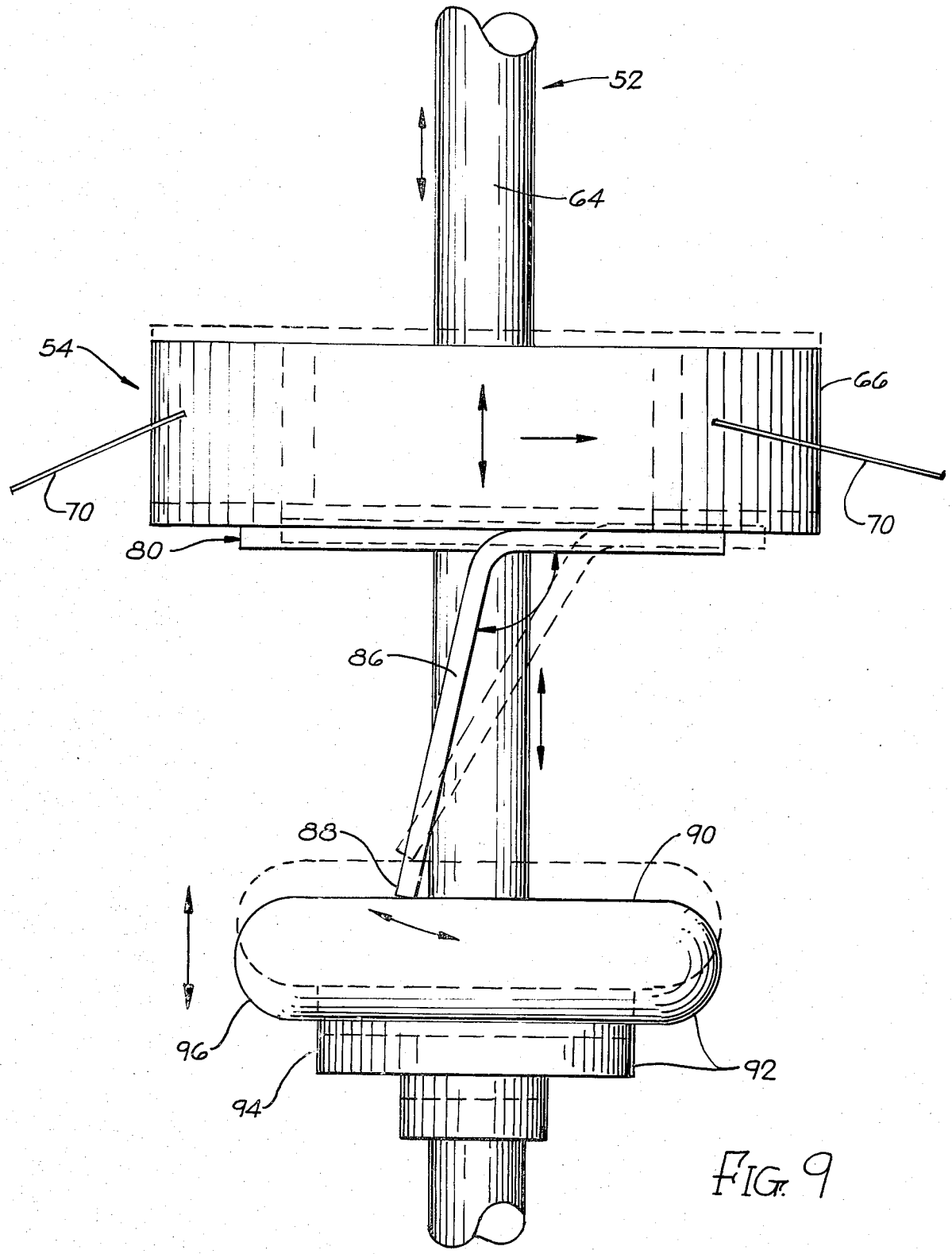
FIG. 9 is an enlarged diagrammatic elevation illustrating the operation of the motion converter of FIG. 3.
Figure 10:
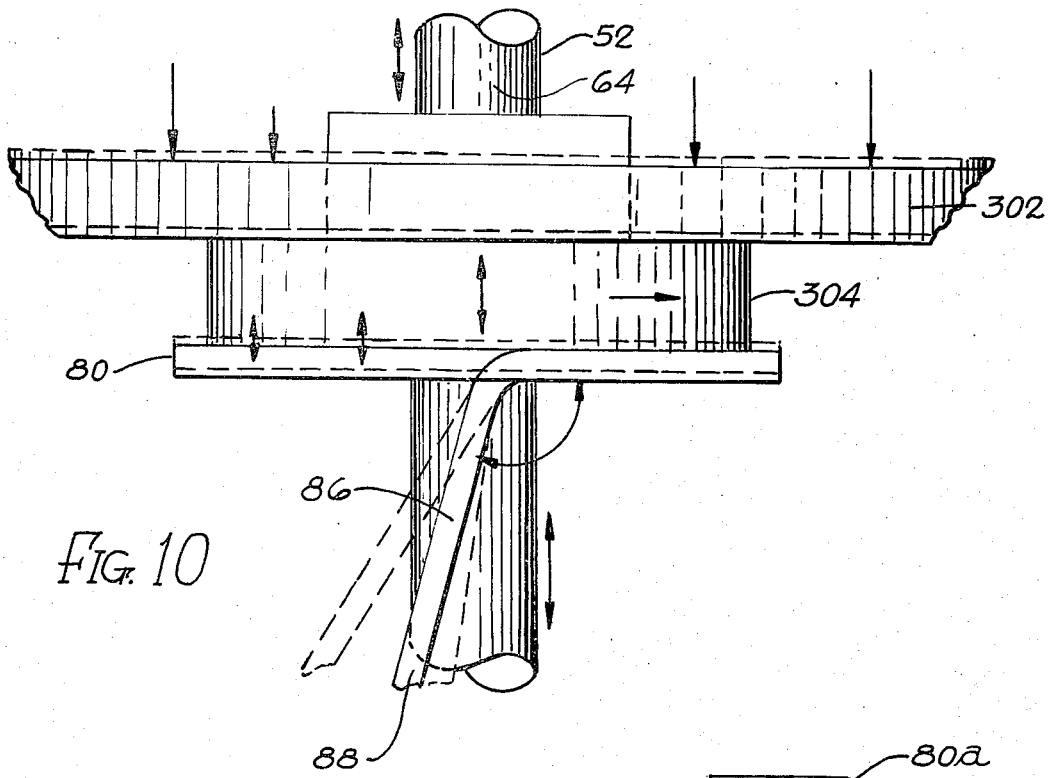
FIG. 10 is a fragmentary elevational view showing a modified application of the motion converter.
Figure 12:
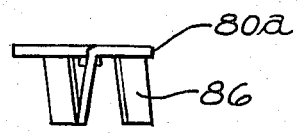
FIGS. 11 and 12 are plan and elevational views of a modified rotary converter element having three flexible arms, instead of four, as illustrated in the previous Figures.

FIG. 10 is a fragmentary enlarged view, similar to FIG. 9, but showing the modified hub 304 for supporting one of the light-modulating wheels 302. The rotary converter element 80 may be the same as previously described.

The light-modulating wheels 302 are preferably in the form of light-transmitting discs which are preferably variegated and multicolored. Thus, the wheels 302 may have a multitude of sectors or areas of a variety of colors. Messages, emblems, designs, ornamentation and the like may also be provided on the wheels 302, if desired. The wheels 302 could be arranged to modulate light in any other suitable manner.

Light to be modulated by the wheels 302 of FIG. 30 is supplied by at least one light source 308, adapted to supply light to the wheels 302. In this case, there are a plurality of light sources 308, which may be in the form of reflector-type incandescent lamps, located below the wheels 302, so as to direct light outwardly through the wheels. The lamps 308 are mounted in a housing 310, which also encloses the other components of the light-modulating display device 300.

In addition to the rotary light-modulating wheels 302, the display device 300 of FIG. 30 is provided with a vibration actuated light-modulating device 310, in which the light is modulated by a layer or film of a light-transmitting liquid 312, through which the light is directed. The liquid 312 is subjected to vibrations which produce ripples, waves, droplets and other disturbances, in and above the liquid, so as to provide an endless variety of ever-changing patterns and other modulations of the light. The arrangement is such that the vibrations of the vibratory shaft or member 52 are transmitted to the liquid 312.

In the arrangement of FIG. 30, the light-transmitting liquid 312 is held in a light-transmitting cell or container 314 having transparent lower and upper walls 316 and 318. The cell 314 is located above the upper wheel 302 so as to receive the modulated light from the wheels 302. The light passes upwardly through the liquid 312 and the transparent walls 316 and 318 of the cell 314. It will be seen that the cell 314 is mounted within the housing 310.

The vibratory motion of the rod or shaft 52 is transmitted to the liquid 312 by providing a vibration transmitting conection between the upper end of the shaft 52 and the lower wall 316 of the cell 314. Such lower wall 316 is flexible and resilient, so that it is able to vibrate in the manner of a diaphragm. The cell 314 is preferably made of a transparent resinous plastic material. The vibration transmitting element may take the form of a resilient element or body 320, retained between the upper end of the shaft 52 and the lower wall 315 of the cell 314. The resilient body 320 is shown as a small resilient ball, having a socket or recess 322 for receiving the upper end of the shaft 52. The lower wall 316 of the cell 314 is preferably formed with a downwardly facing spherically curved seat 324 for receiving and retaining the ball 320. The connecting ball 320 may be made of a soft resilient natural or synthetic rubber material, resinous plastic material, or any other suitable material.

In the device of FIG. 30, the vibratory shaft 52 is preferably biased in an upward direction, so as to maintain the vibration transmitting element 320 in engagement with the lower wall 316 of the cell 314. As shown, the upward biasing action is provided by a compression coil spring 326, mounted around the shaft 52 between a shoulder member 328 thereon and a stationary member 330, illustrated as a bushing through which the shaft 52 is guided. The bushing 330 may be made of silicone rubber, or some other suitable material, and may be mounted in an opening in a horizontal partition 334 in the housing 310.

The cell 314 is subject to thermal expansion and contraction, due to temperature changes, which may be quite pronounced due to the heat generated by the lamps 308. To obviate pressure changes in the cell 314 due to such expansion and contraction, a vent tube 336 is preferably connected to the cell 314 and is arranged to extend between the cell and a point in the surrounding atmosphere at a higher elevation, to avoid spilling any of the liquid 312. If desired, a movable plug 337 may be slidably mounted in the vent tube 336. Such plug may be made of goose grease, or any other suitable material, which will move along the inside of the tube 336 to equalize the pressure between the interior of the cell 314 and the atmosphere.

The liquid 312 may be made of a variety of light-transmitting materials. It is preferred to employ a material which has a melting point such that the material is in a solid state at ordinary room temperatures, but is melted into a liquid state by the heat of the lamps 308. Thus, for example, the liquid 312 may be in the form of a hydrogenated vegetable oil, of the type widely used for cooking, which is solid at ordinary room temperatures, so that the oil will not spill from the cell 314 during shipment and handling of the display device 300. Such solidified vegetable oil is widely known under the trademark "CRISCO".

The display device 300 preferably includes focussing means for focusing and projecting the modulated light. Such focusing means may take the form of a convergent projection lens 340, mounted in a lens tube 342, which is slidably received in an opening 344, formed in the upper end of the housing 310. The slidable mounting of the lens tube 342 makes it possible to move the lens tube to any desired position within the opening 344, so as to focus the modulated light on a ceiling or screen above the lens 340. A strip of felt 346 or some other friction producing material may be employed within the opening 344, so that the lens tube 342 will be frictionally retained in any adjusted position.

The focusing lens 340 projects the combined modulations of the oppositely rotating color wheels 302 and the vibration responsive liquid 312. Thus, an ever-changing and ever-moving pattern of multicolored light is projected by the display device 300. The vibrations of the liquid 312 produce ripples and waves in the liquid, as well as droplets and spray effects above the liquid. All of these effects as well as the ever-changing color effects, are responsive to the rhythms and pulsations of the musical or other signals supplied to the transducer 56.

Figure 31:
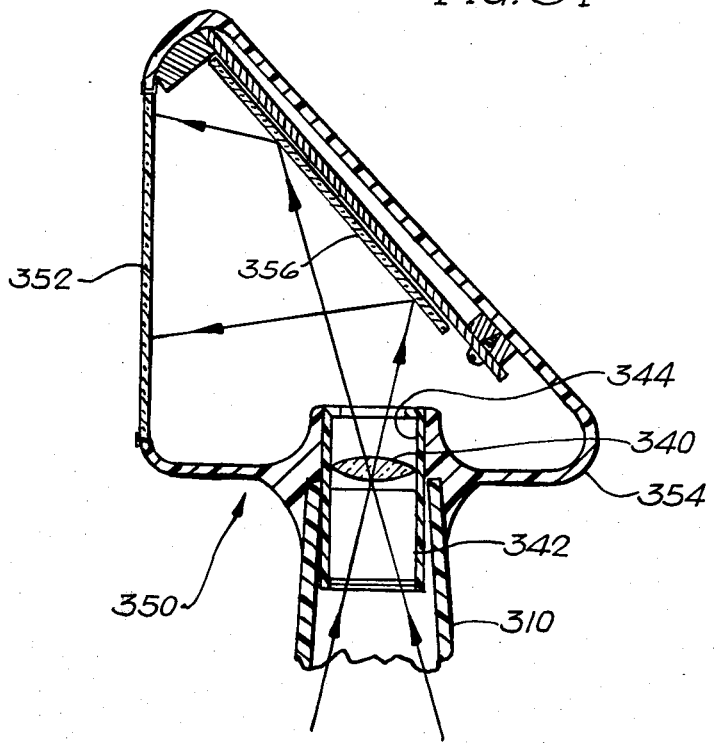
FIG. 31 is a fragmentary diagrammatic elevational section showing a modified construction for the device of FIG. 30, whereby the images are projected on a translucent screen.

FIG. 31 illustrates a modified light-modulating display device 350, which is essentially the same as the display device 300 of FIG. 30, except that the display device 350 includes a translucent projection screen 352, on which the images of the modulated lights are focused. In this case, the translucent screen 352 is mounted in a generally vertical position, as one wall of an additional housing 354, mounted on the upper end of the housing 310. The upwardly projected light from the lens 340 is reflected to the translucent screen 352 by a mirror 356, in the housing 354. It will be understood that various other projection arrangements may be employed.

Figure 32:
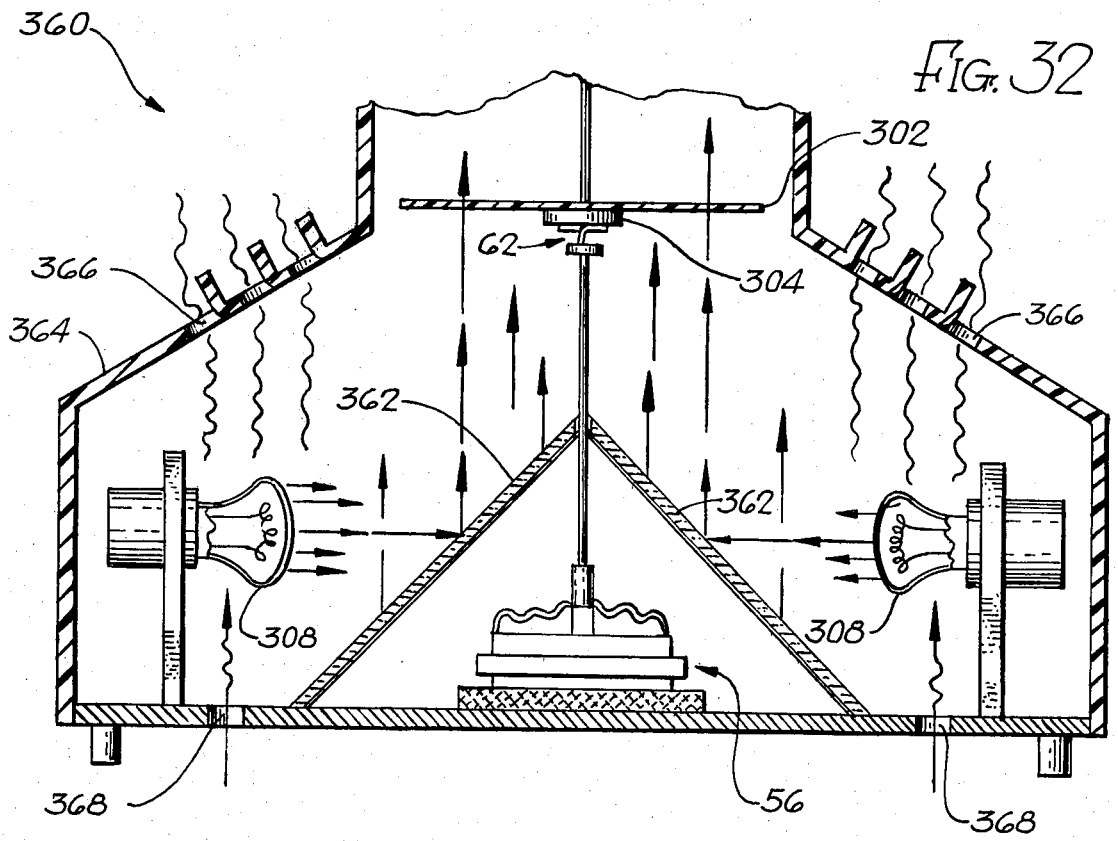
FIG. 32 is a fragmentary elevational section showing a modified light source arrangement for the device of FIG. 30.

FIG. 32 illustrates another modified display device 360, which is the same as the display device 300 of FIG. 30, except that the lamps 308 are no longer disposed directly under the rotatable color wheels 302, but are moved outwardly, out from under the wheels 302, and are aimed horizontally. Mirrors 362 are provided to reflect the light from the lamps 308 upwardly through the color wheels 302. The display device 360 has a modified housing 364 to accommodate the outwardly relocated positions of the lamps 308. Ventilation openings 366 are provided to allow for the escape of heated air from the housing 364, above the lamps 308. Cool air is admitted to the lower portion of the housing 364 through openings 368.

FIGS. 33–43 illustrate various circuits for supplying electrical signals to the transducer 56 of FIGS. 1 and 2. The transducer 56 translates the electrical signals into corresponding vibratory motion of the vibratory member 52. The electrical signals usually represent music or other sounds. Such signals may be derived from the output of a radio, record player, tape player or the like.

Figure 33:
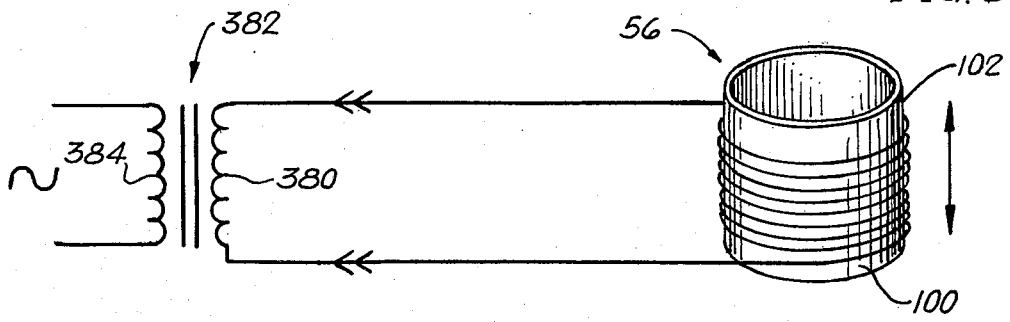
FIG. 33 is an electrical circuit diagram showing a driver circuit for supplying electrical signals to a transducer coil, employed in the vibratory-rotary motion converters of the previous Figures.

In the circuit of FIG. 33, the electrical coil 100 of the transducer 56 is supplied with signals by the secondary winding 380 of an output transformer 382, the primary winding 384 of which may be connected to the output of the radio, or any other source of the signals. The turns ratio of the transformer 382 is selected to match the low impedance of the coil 100 to the output impedance of the signal source. The transformer 382 supplies alternating current signals to the coil 100, without any direct current component.

Figure 34:
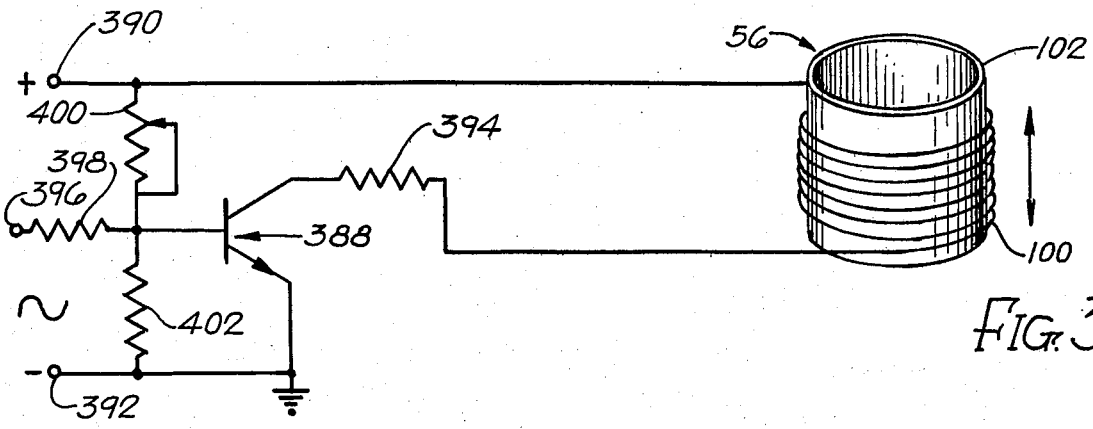
FIGS. 34 and 35 are electrical circuit diagrams of modified driver circuits for the transducer coil.
Figure 43:
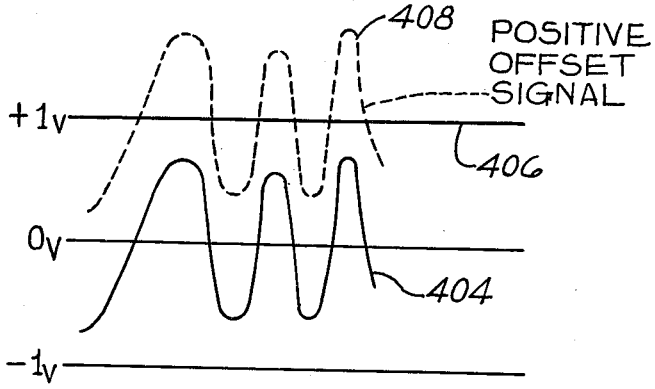
FIG. 43 is a waveform diagram illustrating the effect of supplying a transducer with both an alternating current signal and a direct current offset signal.

FIG. 34 illustrates a transistorized output circuit, utilizing a power output transistor 388 energized by a direct current power source comprising positive and negative terminals 390 and 392. The coil 100 of the transducer 56 is connected in series with a resistor 394, between the positive power supply terminal 390 and the collector of the transistor 388, while the emitter of the transistor is connected to the negative terminal 392. The signal source is connected between an input terminal 396 and a negative terminal 392. The input signals are supplied to the base of the transistor 388 through a resistor 398, connected between the terminal 396 and the base. The desired bias is applied to the base of the transistor 388 by resistors 400 and 402, connected between the base and the respective terminals 390 and 392. In this case, the resistor 400 is adjustable, to provide for adjustment of the bias. The output circuit of FIG. 34 provides a combination of alternating current signals and a current offset to the coil 100 of the transducer. This combination of signals is illustrated in FIG. 43, in which the alternating current signals are represented in full lines by the waveform 404, while the direct current component is represented by a horizontal line 406. The combined positive offset signal is represented by the broken line waveform 408. The direct current component results in a displacement of the transducer coil 100.

Figure 35:
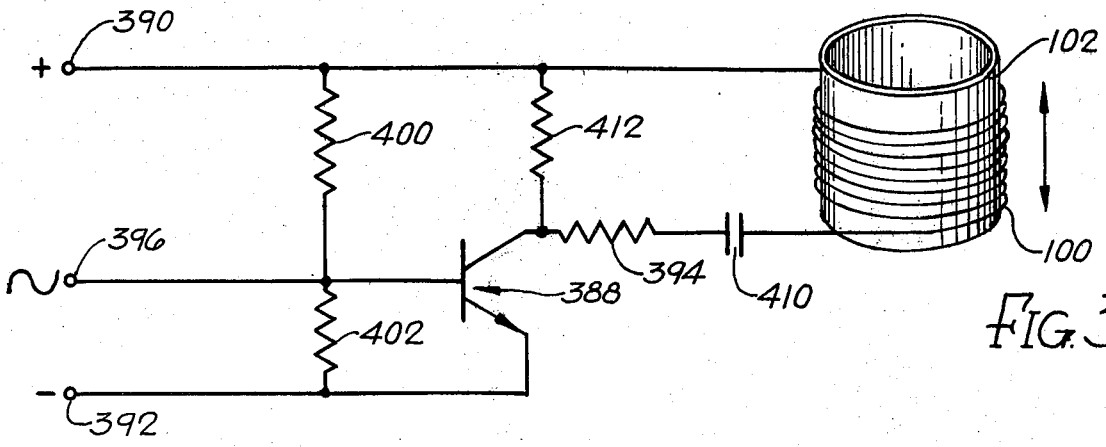

The circuit of FIG. 35 is a slightly modified version of the circuit of FIG. 34. In FIG. 35, the direct current component is blocked from the coil 100 by inserting a capacitor 410 in series with the coil 100. The direct current component is carried by a load resistor 412, connected between the positive terminal 390 and the collector of the transistor 388. In this case, the input terminal 306 is connected directly to the base of the transistor 388. With the circuit of FIG. 35, only the alternating current signals are carried by the coil 100.

Figure 36:
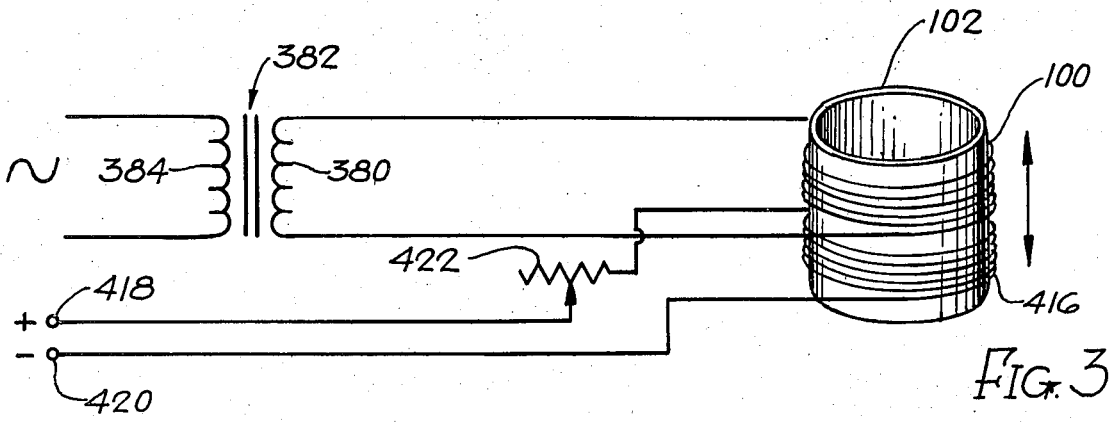
FIG. 36 is an electrical circuit diagram showing a drive circuit for a transducer having two coils.

FIG. 36 illustrates a circuit which is a modified version of the circuit shown in FIG. 33. In FIG. 36, the coil form 102 carries a second electrical coil 416, similar to the coil 100. If desired, the two coils 100 and 416 may be the two portions of the center tapped coil. Input terminals 418 and 420 are connected to the ends of the coil 416, with a variable resistor 424 in series with the coil to vary the current therein. In this case, a direct current is supplied to the terminals 418 and 420 to provide an offset in the position of the coil form 102. The offset may be adjusted by adjusting the resistor 402.

FIG. 37 illustrates a further modification of the circuit of FIG. 36. In FIG. 37, the second coil 416 is connected to the secondary winding 426 of a transformer 428, the primary winding 430 of which may be supplied with second alternating current signals. Thus, two different alternating current signals, represented by wave forms 432 and 434, may be supplied to the coils 100 and 416. The motion of the coil form 102 represents the combination of the two different signals, as indicated by the waveform 436.

FIG. 38 illustrates an output circuit which is a modified version of the circuit of FIG. 33, whereby a loudspeaker 440 may be supplied with the output signals, which are also supplied to the coil 100 of the transducer 56. Provision is made for selectively operating the coil 100 and the loudspeaker 440 at different signal levels. As shown in FIG. 38, a first plug 442 is connected to the secondary winding 380 of the transformer 382, while a first jack 444 is connected to the coil 100. A second jack 446 is connected to the coil 100, with a resistor 448 in series therewith. A second plug 450 is connected to the loudspeaker 440.

The first and second plugs 442 and 450 may be interchanged between the first and second jacks 444 and 446, to change the relative levels of the signals supplied to the coil 100 and the loudspeaker 440. If the first and second plugs 442 and 450 are inserted into the respective jacks 444 and 446, the signals supplied to the loudspeaker 440 will be attenuated by the series resistor 448, so that the volume of the sound produced by the loudspeaker 440 will be reduced. The full signal level is supplied to the coil 100 of the vibratory transducer 56. If the plugs 442 and 450 are interchanged, the signals to both the coil 100 and the loudspeaker 440 will be attenuated by the resistor 448, so that the same reduced signal level will be supplied to both of them. If only the coil 100 is to be energized, the first plug 442 is inserted into the first jack 444, while the second plug 450 is disconnected.

FIG. 39 illustrates a drive circuit, in which the vibratory transducer 56 can be energized from either an internal oscillator 460, or an external signal source, such as a radio, amplifier, tape player or the like, the output of which is plugged into a jack 462. The circuit of FIG. 39 employs a power output transistor 464 which is energized by a power supply 466 having positive and negative supply terminals 468 and 470. The coil of the transducer 56 and a variable resistor 472 are connected in series between the positive terminal 468 and the collector of the transistor 464, while the emitter is connected to the negative terminal 470. A voltage regulator 474 is employed to provide a regulated positive voltage on a supply line 476 which is connected to the oscillator 460 to provide energizing voltage. The base of the transistor 464 is biased by connecting a resistor 478 between the base and the positive supply line 476.

The input jack 462 has an input contact 480 and a switching contact 482 which are in engagement when the jack is not used. The switching contact 482 is connected to the output lead 484 of the oscillator 460. The input contact 480 is connected through a variable resistor 486 and a capacitor 488 to the base of the transistor 464.

When the jack 462 is not used, the output of the oscillator 460 is supplied to the transistor 464, so that the transducer 56 is supplied with an amplified version of the oscillator signal, which causes steady operation of the display device. When an output connector from a radio or the like is plugged into the jack 462, the output of the oscillator is disconnected and the output signal from the radio or the like is supplied to the base of the transistor 464, so that the transducer 56 is supplied with an amplified version of such signal. Thus, signals representing music or other sounds are supplied to the transducer 56, to operate the display device in sympathy with the rhythms and pulsations of the music or other sounds.

FIG. 40 illustrates a circuit whereby two of the display devices 50, as illustrated and described in connection with FIGS. 1 and 2, may be energized by the first and second output channels 491 and 492 of a stereoamplifier 494. As shown in FIG. 40, the transducers 56 of the two display devices 50 are connected in the manner illustrated in FIG. 38. Thus, the first transducer 56 is provided with first and second jacks 444 and 446. Similarly, the second transducer 56 is provided with jacks which will be designated 444*a* and 446*a* for clarity of description. The speaker 440 for the first channel is connected to the jack 446. The second speaker, designated 440*a*, is connected to the jack 446*a*.

The first output channel 491 of the stereo amplifier 494 is connected to the jack 444 of the first transducer 56. The second output channel 492 is connected to the jack 444*a* of the second transducer 56.

With the circuit of FIG. 40, the two display devices 50 will be operated in sympathy with the rhythms and pulsations of the musical signals supplied by the first and second output channels.

Figure 41:
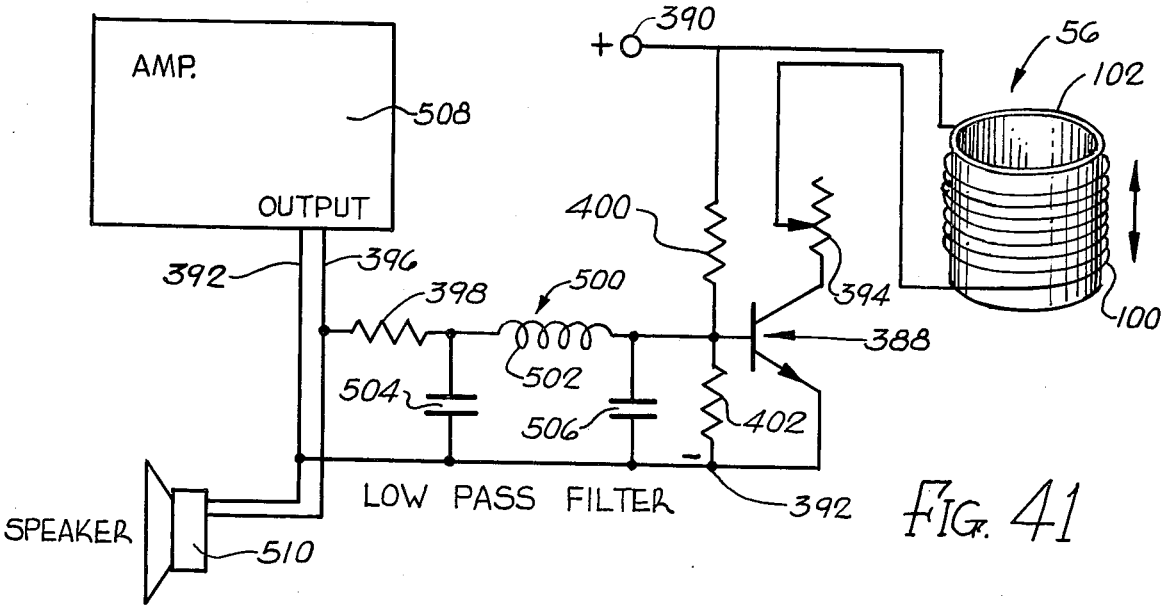
FIG. 41 is a diagram of a driver circuit which incorporates a low pass filter.

FIG. 41 illustrates an output circuit which is a modification of the output circuit of FIG. 34. As before, the coil 100 of the transducer 56 is driven by the transistor 388. In FIG. 41, however, the operation of the transducer 56 is modified by inserting a lowpass filter 500 between the input circuit and the base of the transistor 388. As before, the input circuit comprises the leads or terminals 392 and 396. Any suitable filter construction may be employed. In this case, the lowpass filter 500 comprises a series-connected coil 502 and capacitors 504 and 506, connected across the input circuit. Specifically, the inductance coil 500 is connected in series with the resistor 398 between the input lead 396 and the base of the transistor 388. One side of the capacitor 504 is connected to the junction between the resistor 398 and the coil 502. The other side of the capacitor 504 is connected to the negative or common lead 392. The capacitor 506 is connected between the base of the transistor 388 and the common lead 392.

The leads 392 and 396 are connected to the output of an amplifier 508, which may supply electrical signals representing music or other sounds. A loudspeaker 510 may be connected across the leads 392 and 396.

The lowpass filter 500 transmits low frequency signals, below the upper limit of the pass and of the filter, while attenuating higher frequency. Thus, the transducer 56 is supplied primarily with the low frequency signals from the amplifier 508. Accordingly, the display device 50 responds primarily to the rhythms and pulsations of the low frequency signals.

It will be understood that the lowpass filter 500 is shown by way of example, and that any other suitable type of filter may be employed, to modify the signals which are supplied to the transducer 56. In this way, the operation of the display device 50 may be modified in various ways.

Figure 42:
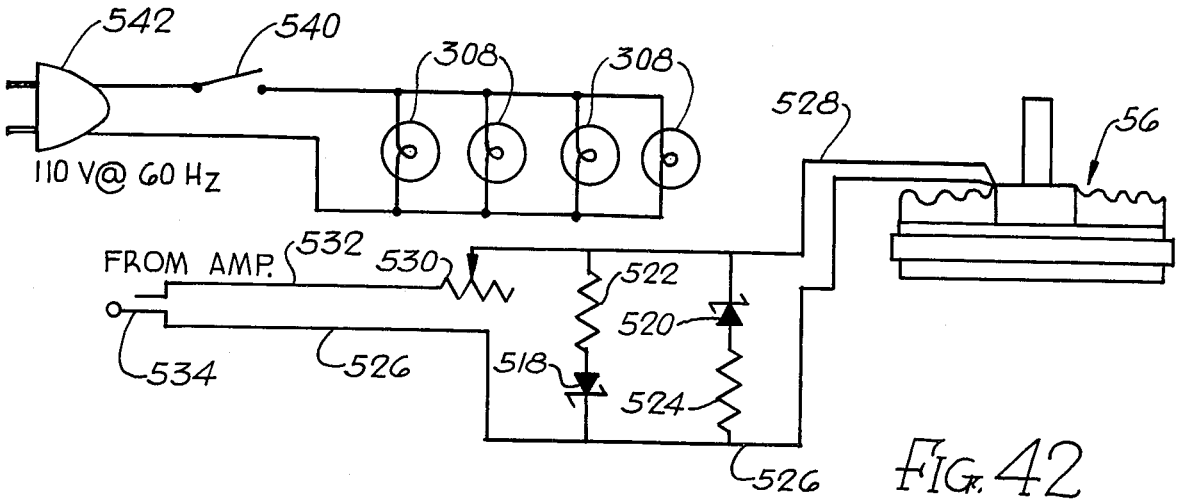
FIG. 42 is a diagram of a drive circuit incorporating Zener diodes.

FIG. 42 illustrates a modified driver circuit which includes means for limiting the electrical signals which are supplied to the transducer 56, to avoid overloading of the transducer. The circuit of FIG. 42 comprises two Zener diodes 518 and 520 which are oppositely polarized and are connected in series with resistors 522 and 524. These series combinations are connected across the leads 526 and 528 from the transducer 56. A resistor 530, which may be variable, is connected between the lead 528 and an input lead 532. A connector 534 may be provided to connect the input leads 526 and 536 to an amplifier, radio, record player, tape player or the like.

At high signal levels, the Zener diodes 518 and 520 will break down and will become conductive, so that the resistors 522 and 524 will be connected in parallel with the transducer 56. The additional loading provided by the resistors 522 and 524 reduces the signal level across the transducer 56, so as to protect it from possible damage. The signal level across the transducer 56 can be varied by adjusting the series resistor 530.

FIG. 42 also includes a power circuit for energizing the lamps 308 for the display device 300 of FIG. 30. The power circuit includes a power control switch 540 and a plug 542 adapted to be connected to a conventional alternating current power outlet.

It will be understood that various other circuits may be employed for driving the transducers of the display devices.

I claim:

1. A device for converting vibratory motion into rotary motion, said device comprising a vibratory member having a generally cylindrical external surface, supporting means for supporting said vibratory member for axial vibratory motion along the cylindrical axis of said surface, vibration producing means for causing such axial vibratory motion of said vibratory member, a rotary member slidably and rotatably mounted around said cylindrical surface of said vibratory member for rotary motion relative thereto about the cylindrical axis of said cylindrical surface, a shoulder member on said vibratory member and having a shoulder facing toward said rotary member, and at least one flexible resilient arm on said rotary member and having an end portion extending toward said shoulder for engagement therewith, said flexible resilient arm being oriented for flexing motion in a direction such that said end portion of said arm has axial and circumferential components of motion relative to said cylindrical axis, said rotary member being biased toward said shoulder to produce a yieldable biasing force between said shoulder and said end portion of said flexible arm so that axial vibration of said vibratory member produces flexure of said arm and consequent rotation of said rotary member.

2. A device according to claim 1, in which said rotary member is thin and plate-like, said flexible resilient arm being formed in one piece with said rotary member.

3. A device according to claim 1, in which said rotary member is thin and plate-like, said flexible resilient arm being formed in one piece with said member, said arm having a bend therein between said member and said end portion of said arm.

4. A device according to claim 1, in which said rotary member is made of thin springy sheet material, said flexible resilient arm being formed in one piece with said rotary member, said arm having a bend therein between said rotary member and said end portion of said arm.

5. A device according to claim 4, in which said sheet material of said rotary member is formed with an opening therein and with an extruded bearing portion around said opening for slidably and rotatably receiving said cylindrical surface of said vibratory member.

6. A device according to claim 1,
in which said rotary member is formed with a bearing opening for slidably and rotatably receiving said cylindrical surface of said vibratory member.

7. A device according to claim 1,
including a second rotary member for frictionally engaging the first mentioned rotary member,
said second rotary member being rotatably mounted around said cylindrical surface of said vibratory member,
said second rotary member being frictionally driven by said first mentioned rotary member.

8. A device according to claim 7,
in which said second rotary member includes a hub for frictionally engaging said first memtioned rotary member,
at least one spoke-like element radiating from said hub,
and a display element mounted on said spoke-like element.

9. A device according to claim 7,
in which said second rotary member comprises a hub for frictionally engaging said first mentioned rotary member,
a plurality of flexible spoke-like elements radiating from said hub,
and a plurality of display elements mounted on said respective spoke-like elements.

10. A device according to claim 7,
in which said second rotary member comprises a hub for frictionally engaging said first mentioned rotary member,
and a variegated light modulating member rotatable with said hub.

11. A device according to claim 7,
in which said second rotary member comprises a hub for frictionally engaging said first mentioned rotary member,
and a variegated light transmitting disc rotatable with said hub for modulating light passing through said disc.

12. A device according to claim 1,
in which said flexible resilient arm extends at an inclined angle from said rotary member,
said angle being inclined toward said shoulder and between axial and perpendicular directions relative to the cylindrical axis of said cylindrical surface.

13. A device according to claim 1,
in which said rotary member is thin and plate-like,
said flexible resilient arm being formed in one piece with said rotary member and being bent therefrom at an inclined angle which is inclined between axial and perpendicular directions relative to the cylindrical axis of said cylindrical surface.

14. A device according to claim 1,
in which said rotary member includes a pair of such flexible resilient arms disposed at diametrically opposite points relative to said cylindrical surface.

15. A device according to claim 1,
in which said rotary member includes a plurality of such flexible resilient arms spaced at substantially equal intervals around said cylindrical surface.

16. A device according to claim 1,
in which said shoulder member includes soft resilient material for engaging said end portion of said flexible resilient arm.

17. A device according to claim 1,
in which said shoulder member comprises a ring shaped member mounted around said cylindrical surface of said vibratory member.

18. A device according to claim 1,
in which said vibration producing means comprise a transducer for translating electrical signals into vibratory motion of said vibratory member.

19. A device according to claim 18,
in which said transducer comprises magnet means for producing a magnetic field,
an electrical coil for receiving the electrical signals,
and means for mounting said electrical coil on said vibratory member and in said magnetic field.

20. A device according to claim 18,
in which said transducer comprises magnet means for producing a magnetic field,
a plurality of electrical coils for receiving a plurality of electrical signals,
and means for mounting said electrical coils on said vibratory member and in said magnetic field for producing vibratory motion of said vibratory member in response to said electrical signals.

21. A device according to claim 18,
in which said transducer comprises magnet means for producing a magnetic field,
a first electrical coil for receiving said electrical signals,
a second electrical coil,
means for mounting said first and second electrical coils in said magnetic field and on said vibratory member for producing vibrations thereof,
and supply means for supplying additional electrical signals to said second electrical coil.

22. A device according to claim 21,
in which said supply means comprise means for supplying direct current to said second coil for producing a corresponding offset movement of said vibratory member.

23. A device according to claim 21,
in which said supply means include means for supplying alternating current signals to said second coil for producing corresponding additional vibratory motion of said vibratory member.

24. A device according to claim 1,
in which said vibratory member is cylindrical and rod-like in form.

25. A mobile display device,
comprising a vibratory member having an external substantially cylindrical surface,
supporting means for mounting said vibratory member in a substantially vertical position for axial vibratory motion along the cylindrical axis of said cylindrical surface,
a transducer for translating electrical signals into such axial vibratory motion of said vibratory member,
a rotary member rotatably mounted around said cylindrical surface for rotary motion about said cylindrical axis therof,
a vibratory-rotary motion converting device connected between said vibratory member and said rotary member for imparting rotary motion to said rotary member in response to vibratory motion of said vibratory member, at least one mobile display element positioned outwardly from said rotary member, and a flexible resilient connecting element forming a flexible resilient connection between said rotary member and said mobile display element for causing said mobile display element to rotate with said rotary member while affording flexibility therebetween.

26. A mobile display device according to claim 25, in which said vibratory member is generally cylindrical and rod-like in form.

27. A mobile display device according to claim 25, in which said transducer comprises an electrical coil for receiving said electrical signals, and mounting means for mounting said coil on said vibratory member and in said magnetic field for producing vibratory motion of said vibratory member in response to said electrical signals.

28. A mobile display device according to claim 25, in which said vibratory-rotary motion converting device comprises a rotary element for driving said rotary member, said rotary element being slidably and rotatably mounted around said cylindrical surface of said vibratory member for rotary motion relative thereto about the cylindrical axis of said cylindrical surface, and a shoulder member on said vibratory member and having a shoulder facing toward said rotary element, said rotary element including at least one flexible resilient arm having an end portion extending toward said shoulder for engagement therewith, said flexible resilient arm being oriented for flexing movement in a direction such that said end portion of said arm has axial and circumferential components of motion relative to said cylindrical axis, said rotary element being biased toward said shoulder to produce a yieldable biasing force between said shoulder and said end portion of said flexible arm so that axial vibration of said vibratory member produces flexure of said arm and consequent rotation of said rotatable element.

29. A mobile display device according to claim 25, in which said display element is generally spherical in shape.

30. A mobile display device according to claim 25, in which said flexible resilient connecting element is spoke-like in form.

31. A mobile display device according to claim 25, in which said flexible resilient connecting element is in the form of a flexible resilient wire.

32. A mobile display device according to claim 25, including a plurality of such mobile display elements positioned outwardly from said rotary member, and a plurality of such flexible resilient connecting elements forming respective flexible resilient connections between said rotary member and said mobile display elements for causing said mobile display elements to rotate with said rotary member while affording flexibility therebetween.

33. A mobile display device according to claim 32, in which said flexible resilient connecting elements are like wire spokes in form.

34. A mobile display device according to claim 25, including an ultraviolet light source for supplying ultraviolet light to said display element, said display element having a fluorescent material at least on the surface thereof for fluorescing when supplied with ultraviolet light.

35. A mobile display device according to claim 25, including a protective housing around the other components of said device, at least a portion of said housing being transparent to reveal said rotary member and said display element and said connecting element.

36. A device for producing a display of modulated light, said device comprising a vibratory member having an external generally cylindrical surface, supporting means for mounting said vibratory member in a generally vertical position for axial vibratory motion along the cylindrical axis of said surface, at least one rotary member rotatably mounted around said cylindrical surface for rotary motion about said cylindrical axis, vibratory-rotary conversion means connected between said vibratory member and said rotary member for imparting rotary motion to said rotary member in response to vibratory motion of said vibratory member, a transducer for translating electrical signals into axial vibratory motion of said vibratory member and thereby producing rotary motion of said rotary member, a light-modulating wheel rotatable with said rotary member, at least one light source for directing light upon said wheel, said wheel being variegated for producing modulation of such light, a cell containing a light-transmitting liquid for receiving modulated light from said wheel, a vibratory connection between said vibratory member and said cell for producing vibratory motion of said liquid in response to the vibratory motion of said vibratory member, the vibratory motion of said liquid producing vibratory modulation of the light from said wheel, and image producing means for receiving the light from said liquid and producing images which are modulated by the rotary motion of said wheel and the vibratory motion of said liquid.

37. A device according to claim 36, in which said vibratory member is generally cylindrical and rod-like in form.

38. A device according to claim 36, in which said transducer comprises an electrical coil for receiving said electrical signals, and mounting means for mounting said coil on said vibratory member and in said magnetic field for producing vibratory motion of said vibratory member in response to said electrical signals.

39. A device according to claim 36, in which said vibratory-rotary motion converting device comprises a rotary element for driving said rotary member, said rotary element being slidably and rotatably mounted around said cylindrical surface of said vibratory member for rotary motion relative thereto about the cylindrical axis of said cylindrical surface, and a shoulder member of said vibratory member and having a shoulder facing toward said rotary element, said rotary element including at least one flexible resilient arm having an end portion extending toward said shoulder for engagement therewith, said flexible resilient arm being oriented for flexing movement in a direction such that said end portion of said arm has axial and circumferential components of motion relative to said cylindrical axis, said rotary element being biased toward said shoulder to produce a yieldable biasing force between said shoulder and said end portion of said flexible arm so that axial vibration of said vibratory member produces flexure of said arm and consequent rotation of said rotatable element.

40. A device according to claim 36, in which said wheel is in the form of a light-transmitting disc.

41. A device according to claim 36, including an additional rotary member rotatably mounted around said cylindrical surface for rotary motion about said cylindrical axis, additional vibratory-rotary conversion means connected between said vibratory member and said additional rotary member for imparting rotary motion thereto in the opposite direction relative to the rotation of said first mentioned rotary member, and an additional light-modulating wheel rotatable with said additional rotary member, said additional wheel being variegated for producing modulation of the light from said light source.

42. A device according to claim 36, in which said cell comprises a flexible resilient wall in contact with said light-transmitting liquid, said vibratory connection being provided between said vibratory member and said wall for producing vibratory movement of said liquid.

43. A device according to claim 36, including a pressure equalizing tube extending from said cell to the surrounding atmosphere, and a movable pressure equalizing plug slidably received in said tube.

44. A device according to claim 36, in which said liquid has a melting point such that said liquid solidifies at ordinary room temperatures and is liquefied by the heat of said light source.

45. A device according to claim 36, said image producing means being in the form of focusing means for focusing and projecting said images.

46. A device according to claim 36, said image producing means comprising a lens for focusing and projecting said images.

47. A device according to claim 36, including a projection screen, said image producing means comprising a lens for focusing and projecting said images on said projection screen.

48. A device according to claim 36, including a translucent projection screen, said image producing means comprising a lens for focusing said images and a mirror for reflecting said images upon said screen.

49. A device for producing a display of modulated light, said device comprising a vibratory member having an external generally cylindrical surface, supporting means for mounting said vibratory member in a generally vertical position for axial vibratory motion along the cylindrical axis of said surface, at least one rotary member rotatably mounted around said cylindrical surface for rotary motion about said cylindrical axis, vibratory-rotary conversion means connected between said vibratory member and said rotary member for imparting rotary motion to said rotary member in response to vibratory motion of said vibratory member, a transducer for translating electrical signals into axial vibratory motion of said vibratory member and thereby producing rotary motion of said rotary member, a light-modulating wheel rotatable with said rotary member, and at least one light source for directing light upon said wheel, said wheel being variegated for producing modulation of such light.

50. A device according to claim 49, including image producing means for producing images which are modulated by the rotary motion of said wheel.

51. A device according to claim 49, in which said wheel is in the form of a light-transmitting disc.

52. A device according to claim 49, including an additional rotary member rotatably mounted around said cylindrical surface for rotary motion about said cylindrical axis, additional vibratory-rotary conversion means connected between said vibratory member and said additional rotary member for imparting rotary thereto in the opposite direction relative to the rotation of said first mentioned rotary member, and an additional light-modulating wheel rotatable with said additional rotary member, said additional wheel being variegated for producing modulation of the light from said light source.

* * * * *